US010792705B2

(12) United States Patent
Davis et al.

(10) Patent No.: US 10,792,705 B2
(45) Date of Patent: Oct. 6, 2020

(54) AMPLIFIED BALLISTIC SEPARATOR FOR SEPARATING MATERIAL

(71) Applicant: CP Manufacturing, Inc., San Diego, CA (US)

(72) Inventors: Nicholas Davis, San Diego, CA (US); Robert Davis, San Diego, CA (US)

(73) Assignee: CP Manufacturing, Inc., San Diego, CA (US)

( * ) Notice: Subject to any disclaimer, the term of this patent is extended or adjusted under 35 U.S.C. 154(b) by 0 days.

(21) Appl. No.: 16/724,245

(22) Filed: Dec. 21, 2019

(65) Prior Publication Data

US 2020/0282428 A1 Sep. 10, 2020

Related U.S. Application Data

(60) Provisional application No. 62/932,080, filed on Nov. 7, 2019, provisional application No. 62/912,574, filed on Oct. 8, 2019, provisional application No. 62/814,107, filed on Mar. 5, 2019.

(51) Int. Cl.
*B07B 13/10* (2006.01)
*B07B 13/00* (2006.01)
*B03B 9/06* (2006.01)

(52) U.S. Cl.
CPC ..... *B07B 13/10* (2013.01); *B07B 13/003* (2013.01); *B03B 9/06* (2013.01)

(58) Field of Classification Search
CPC .. B07B 1/12; B07B 1/14; B07B 1/145; B07B 1/15; B07B 1/16; B07B 13/003; B07B 13/10; B07B 13/11; B07B 13/113; B07B 13/116
See application file for complete search history.

(56) References Cited

U.S. PATENT DOCUMENTS 5,611,435 A * 3/1997 Goschl ..... B07B 13/003 198/630
5,740,922 A * 4/1998 Williams ..... A01D 17/06 209/668
6,053,330 A * 4/2000 Lavoie ..... B07B 1/14 209/394

(Continued)

FOREIGN PATENT DOCUMENTS

EP 1618968 A1 * 1/2006 ..... B65G 25/02
EP 1832352 A1 * 9/2007 ..... B65G 25/02

(Continued)

OTHER PUBLICATIONS

English Translation of EP 1618968 A1; Inv: Mirko Winter; Pub. Date: Jan. 2006 (Year: 2006).*

(Continued)

*Primary Examiner* — Joseph C Rodriguez
(74) *Attorney, Agent, or Firm* — Manuel de la Cerra

(57) ABSTRACT

A novel ballistic separator for separating material is disclosed that includes a separator bed adapted to contact the material. The bed has a first agitator with a top surface, with the top surface comprising a conveyor connected to the first agitator. A crankshaft imparts an oscillating motion to the first agitator and conveyor, which move fixed together relative to the oscillating motion. The conveyor is constructed to move laterally across to the top surface.

14 Claims, 39 Drawing Sheets

(56) References Cited

U.S. PATENT DOCUMENTS

2017/0144196 A1* 5/2017 Schulze Buxloh ..... B07B 1/42

FOREIGN PATENT DOCUMENTS

| | | | | |
|---|---|---|---|---|
| EP | 1916205 | A1 * | 4/2008 | ..... F16C 3/12 |
| EP | 2062658 | A2 * | 5/2009 | ..... B07B 1/16 |
| WO | WO-9845056 | A1 * | 10/1998 | ..... B07B 13/003 |
| WO | WO-2017162541 | A1 * | 9/2017 | ..... B07B 13/003 |

OTHER PUBLICATIONS

English Translation of EP 1832352 A1; Inv: Hartner Helmut; Pub. Date: Sep. 2007 (Year: 2007).*

* cited by examiner (Prior Art EP 1832352B1)

AMPLIFIED BALLISTIC SEPARATOR FOR SEPARATING MATERIAL

RELATED APPLICATIONS

This application claims priority as the non-provisional of U.S. Patent Application 62/932,080 filed on Nov. 7, 2019, U.S. Patent Application 62/912,574 filed on Oct. 8, 2019, and U.S. Patent Application 62/814,107 filed on Mar. 5, 2019, all of which are assigned to the same assignee as the present application. Each of these applications is incorporated herein by reference.

This application related to U.S. patent application Ser. No. 16/193,815 filed on Nov. 16, 2018, U.S. Pat. No. 8,517,181 issued on Aug. 27, 2013, U.S. Pat. No. 9,027,762 issued on May 12, 2015, U.S. Patent Application 62/037,038 filed on Aug. 13, 2014, U.S. patent application Ser. No. 14/797,088 filed on Jul. 11, 2015, U.S. Patent Application 62/153,901 filed on Apr. 28, 2015, U.S. patent application Ser. No. 14/797,090 filed on Jul. 11, 2015, U.S. Patent Application 62/60219 filed on May 12, 2015, U.S. Patent Application 62/153,901 filed on Apr. 28, 2015, U.S. patent application Ser. No. 14/811,164 filed on Jul. 28, 2015, U.S. patent application Ser. No. 14/797,093 filed on Jul. 11, 2015, and U.S. Patent Application 62/238,805 filed on Oct. 8, 2015, all of which are assigned to the same assignee as the present application. Each of these applications is incorporated herein by reference.

TECHNICAL FIELD

The present invention relates generally to machines used to sort materials and mixed recyclable materials.

BACKGROUND

Ballistic separators are used to separate materials based on mechanical properties. A paddle is typically attached to two synchronized crankshafts such that the paddle moves in a circular or elliptical motion. The paddles form a bed that is typically angled upward, and angled cleats are added to the surface. Each adjacent paddle is typically rotationally offset so that the paddles move into the forward phase in series instead of moving together. The forward toss of the ballistic separator will move a fraction of the material—flat and flexible materials—up the paddle once per revolution, moving from cleat to cleat, while round, heavy or voluminous materials (a second fraction) will bounce off the paddles and not engage the cleats. This "rolling" fraction then bounces off the back lower edge of the inclined bed, separating the flat and rolling fractions. Typically, the paddles will also have sizing grates built in, such that materials smaller than the grate size will pass through the paddle rather than moving up or down.

Due to the need to engage the flat and flexible materials with the cleats and paddles, there is an upper limit to how quickly the paddles can rotate before the material disengages and no longer climbs the paddles. This limits the rotational speed of the paddles, which in turn limits the surface velocity of the flat fraction as it climbs the machine and moves forward once per revolution, putting an upper limit on the capacity of the machine to process flat material. In addition, the higher the bed is angled, the better it is at bouncing the rolling fraction backward, increasing separation efficiency. However, the higher the angle of inclination, the more difficult it is for flat material to climb, as it reduces the throw distance, and there is a chance that material will not climb to the next cleat with every rotation, further decreasing throughput. At some angle of inclination, flat material will no longer climb the bed, and all material will fall off the back.

Ballistic Separators are known to be of low cost to operate per hour in comparison to machines of similar function, such as disc screens. However, their limitations in throughput and efficiency limit their utility and increase their operational cost per volume processed rather than per hour operated. An invention to increase the throughput of the machine would allow for a combination of low operating cost, high throughput, and high separation efficiency.

For example, when processing recyclable packaging material consisting of a mixture of paper, corrugated containers, plastic bottles, and metal cans, glass and finds, and other residual items such as film plastics, a typical ballistic separator will have an input capacity of around 7 tons per hour, of which approximately 4 tons per hour is flat material such as paper and film plastic. Such a machine will typically have eight paddles, each of which is about a foot and a half or half a meter wide, for an overall width of around 12 feet or four meters. An equivalently sized disc screen, processing the same material, will have an input capacity of around 16 tons per hour.

Different paddles and cleat configurations can be used to attempt to increase either throughput or angle of inclination. For example, longer cleat spacing will allow material to move further up the paddle with each rotation, increasing throughput, but will also limit the angle of inclination of the paddles, decreasing separation efficiency. Taller cleats can be used to increase the angle of inclination of the paddles, but flat material will struggle to climb over the cleats, decreasing throughput.

There have been attempts to increase the travel speed of flat materials beyond what is generated by the rotation of the paddles. Most notably, fans are added to the back of the paddles in an attempt to blow flat materials forward, increasing throughput or angle of inclination, as the flat material moves further forward with each rotation. However, this has met with limited success, as paddles are typically around 20 feet or 6 meters long, and air pushed by a fan will disperse before reaching the upper end of the paddle, so that the throughput and separation efficiency of the machine is greater toward the back than toward the front, and material will tend to accumulate as it slows down, therefore limiting the machine to the mechanical properties of the unassisted region.

Other attempts have focused on making the machine wider. For example, there was a 10 meter wide machine produced. However, the amount of torque required from the output gearbox grows linearly with the number of paddles, while the diameter of the crankshaft is still limited to what will fit below the paddles. More room can be created by increasing the displacement radius of the crankshaft; however, this will increase radial forces and momentum on the mechanical components of the shaft. The above machine quickly destroyed itself due to the forces of the machine. Currently, the widest commercially available machine is about eight meters wide. Making a machine that wide creates further problems, as material must be fed to and gathered from the machine from multiple points, creating issues with integrating the machine and driving up the expense of installing the machine. Moreover, the crankshafts get much more expensive as they grow in diameter, creating further expense issues. The above eight-meter wide machine still has less throughput than a typical disc screen.

What is therefore needed is a novel ballistic separator that overcomes these deficiencies.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form, as a prelude to the more detailed description that is presented later.

The apparatus, systems, and methods described herein elegantly solve the problems presented above. A novel ballistic separator for separating material is disclosed. The separator includes a separator bed adapted to contact the material, with the bed further comprising an agitator and an amplified agitator. The amplified agitator has a total lateral displacement. The separator also includes a crankshaft kinematically linked to the agitator and the amplified agitator. The crankshaft has a total lateral displacement. The amplified agitator total lateral displacement is larger than the crankshaft total lateral displacement.

A second crankshaft may be kinematically linked to the agitator and the amplified agitator. Optionally, a plurality of agitators and a plurality of amplified agitators may be kinematically linked to the crankshaft. The crankshaft may have multiple phase regions, and adjacent amplified agitators may be connected to different phase regions.

The agitator may have a total lateral displacement that is less than the amplified agitator total lateral displacement. The agitator's movement may trace a circle, while the amplified agitator's movement may trace a non-circle.

The amplified agitator comprises a saw tooth, and may wrap around a portion of the agitator. Also, the amplified agitator total lateral displacement may be at least 1.5 times larger than the crankshaft total lateral displacement.

The amplified agitator may also be kinematically linked to the crankshaft by a cam follower. The cam follower may include a notch, an agitator pivot connected to the agitator and an amplified agitator pivot connected to the amplified agitator. A cam may be disposed of in the notch, and the cam may be fixed relative to the movement of the crankshaft. Alternatively, the cam follower may include a notch, a fixed pivot and an amplified agitator pivot connected to the amplified agitator. A cam may be disposed of in the notch, and the cam may be connected to the agitator.

The separator may also have an alignment groove and an alignment pin disposed therein, wherein the alignment groove and alignment pin maintain a preset relative movement of the agitator relative to the amplified agitator.

A ballistic separator for separating material is also disclosed that includes a separator bed adapted to contact the material. The bed has an agitator with a top surface and a conveyor adapted to transport the material along the top surface. A crankshaft is kinematically linked to the agitator and has a rotation action. The conveyor is connected to the rotation action of the crankshaft so as to move the conveyor relative to the top surface.

The conveyor may be a belt, a chain, a plurality of rotating shafts or a disc screen. the conveyor may be connected to the rotation action via a belt or a chain or may be directly connected.

The separator may have a second agitator with a second top surface having a second conveyor adapted to transport material along the top surface. The crankshaft may be kinematically linked to the second agitator, and the second conveyor may be connected to the rotation action of the crankshaft so as to move the second conveyor relative to the second top surface. The second agitator may be positioned adjacent to the agitator. The second conveyor may be a belt, a chain, a plurality of rotating shafts or a disc screen. The crankshaft may have multiple phase regions, and the agitator and second agitator are connected to different phase regions.

The bed may be inclined. The bed may also have a lower edge and a higher edge, and the separator separates the material into a first fraction located adjacent to the higher edge and a second fraction located adjacent to the lower edge. The bed may be perforated to allow a third fraction of the material to travel through the bed.

Additional aspects, alternatives and variations, as would be apparent to persons of skill in the art, are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

DETAILED DESCRIPTION OF EXXAMPLE EMBODIMENTS

Figure 1A:
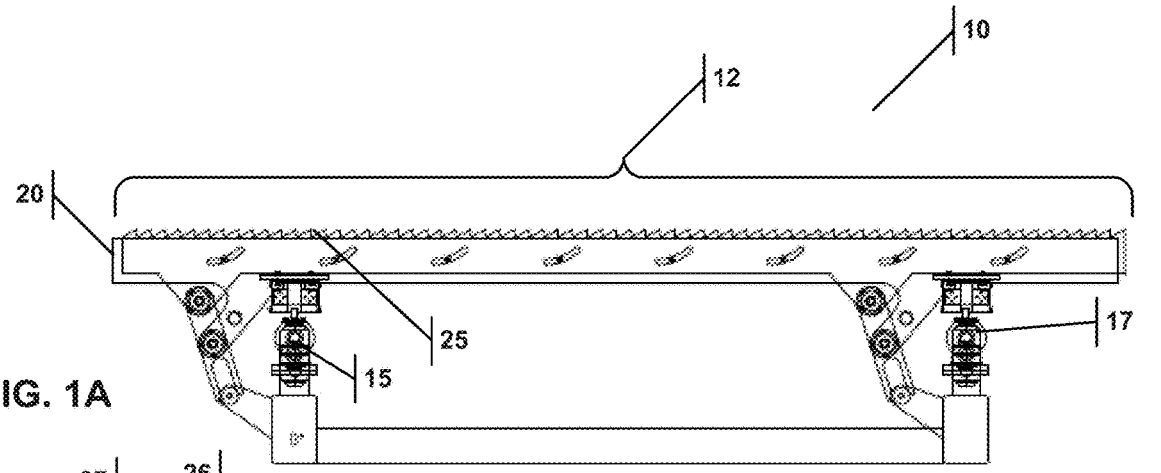
FIG. 1A illustrates a novel amplified ballistic separator where both crankshafts are at 0 degrees (i.e., highest elevation).

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection, unless otherwise noted.

The following list of example features corresponds to the figures and is provided for ease of reference, where like reference numerals designate corresponding features throughout the specification and figures:

Amplified Ballistic Separator 10
Separator Bed 12
Crankshaft 15, 15A
Second Crankshaft 17
Agitator (paddle) 20
Agitator (used with wrap-around) 20A
Perforations 22
Amplified Agitator (Saw Tooth) 25
Amplified Agitator (Wrap-Around, also Saw Tooth) 25A
Alignment Groove 26
Alignment Pin 27
Crankshaft total lateral displacement 30
Amplified Agitator Total Lateral Displacement 35
Cam 40
Cam Follower 45
Alternate Cam Follower 45A
Cam Follower Notch 47
Fixed Pivot 48
Agitator Pivot 50
Amplified Agitator Pivot 55
Travel Trace of Agitator Pivot 60
Agitator Total Lateral Displacement 62
Travel Trace of Amplified Agitator Pivot 65
Amplified Lateral Movement of Amplified Agitator 70
Crankshaft Saddle 75
Agitator Connection Structure 80
Crankshaft Phase 1 Region 85
Crankshaft Phase 2 Region 90
Mixed Material Load Position 100
First Fraction of Separated Material Movement 105
First Fraction of Separated Material Offload Position 110
Second Fraction of Separated Material Movement 115
Second Fraction of Separated Material Offload Position 120
Third Fraction of Separated Material Offload Position 122
Lower Edge of Bed 125
Higher Edger of Bed 130
Straight Shaft 135
Eccentric Discs 140
Straight Shaft/Eccentric Disc Mount 145
Rotation of Eccentric Disc Relative to Crankshaft Saddle 150
Ballistic Separator 200
Top Surface 205
Conveyor 210
Conveyor Movement Relative to Top Surface 212
Crankshaft Rotation Action 214
Sheave 215
Sheave Rotation 217
Belt/Chain 220
Adjacent (Second) Agitator 225
Conveyor (Rotating Shafts) 230
Space Between Rotating Shafts 235
Conveyor (Disc Screen) 240
Space Between Discs 245
Eccentric Conveyor Hub 250
Conveyor Hub Connecting Shaft 255
Conveyer Hub Bearing 260
Connecting Shaft Input 265

Figure 1B:
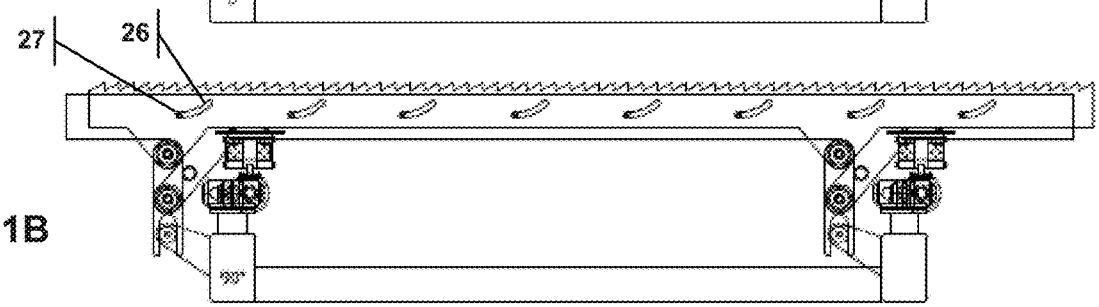
FIG. 1B illustrates a novel amplified ballistic separator where both crankshafts are at 90 degrees clockwise from FIG. 1A (90-degree position).
Figure 1C:
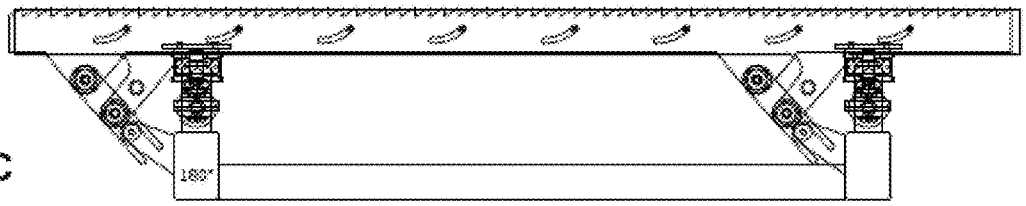
FIG. 1C illustrates a novel amplified ballistic separator where both crankshafts are at 90 degrees clockwise from FIG. 1B (180-degree position).
Figure 1D:
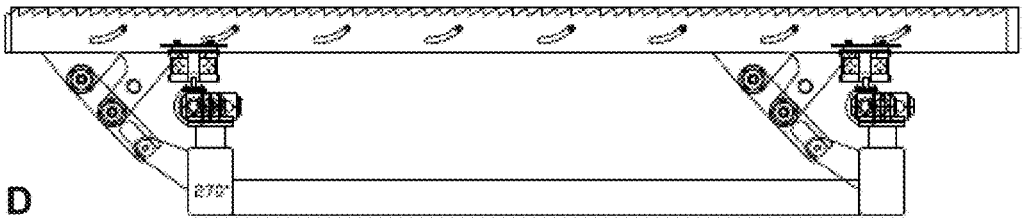
FIG. 1D illustrates a novel amplified ballistic separator where both crankshafts are at 90 degrees clockwise from FIG. 1C (270-degree position).
Figures 2A, 2B, 2C, 2D:
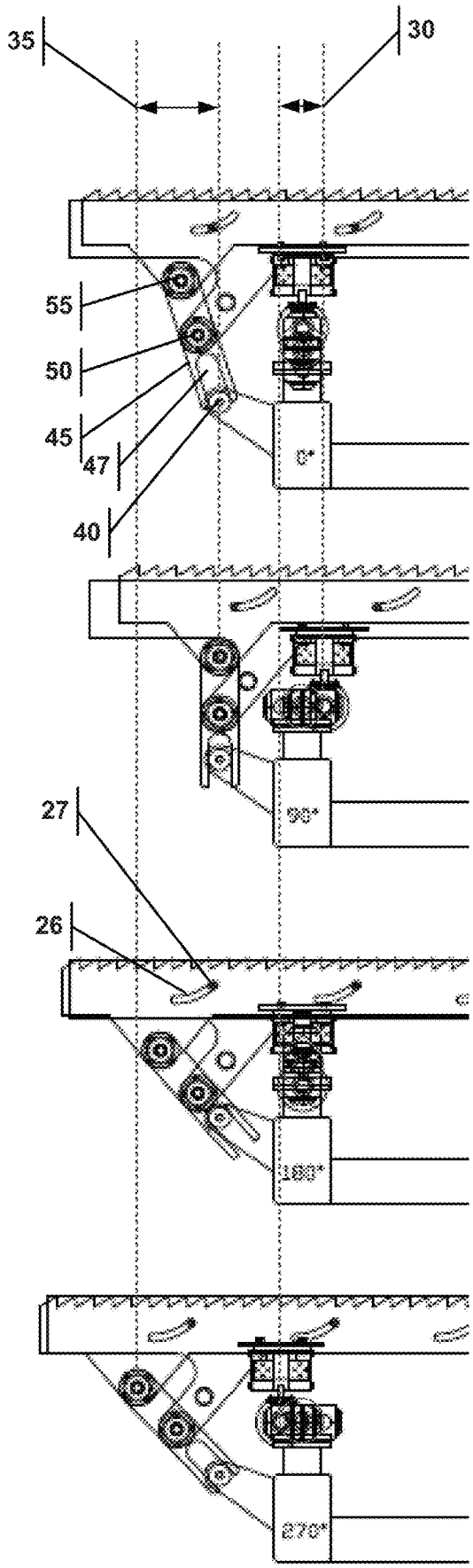
FIG. 2A illustrates a novel amplified ballistic separator where the crankshaft is at 0 degrees (i.e., highest elevation), with markings showing total displacements.
FIG. 2B illustrates a novel amplified ballistic separator where the crankshaft is at 90 degrees clockwise from FIG. 2A, with markings showing total displacements (90-degree position).
FIG. 2C illustrates a novel amplified ballistic separator where the crankshaft is at 90 degrees clockwise from FIG. 2B, with markings showing total displacements (180-degree position).
FIG. 2D illustrates a novel amplified ballistic separator where the crankshaft is at 90 degrees clockwise from FIG. 2C, with markings showing total displacements (270-degree position).

FIG. 1A illustrates a novel ballistic separator 10 for separating material. The separator 10 includes a separator bed 12 adapted to contact the material. The bed 12 further includes an agitator 20 and an amplified agitator 25 (shown as a saw tooth) that are kinematically linked to a crankshaft 15. The pivot 55 of the amplified agitator 25 is located further up the mechanical arm linking the agitator 20 and the amplified agitator 25 to the crankshaft 15 from where the agitator pivot 50 (shown in FIG. 4A), so that the amplified agitator 25 has an amplified agitator total lateral displacement 35 that is greater than the agitator total lateral displacement 62 and greater than the crankshaft total lateral displacement 30. The kinematic linkage to the crankshaft 15 means that movement of the crankshaft 15 causes, through that linkage, movement of the agitator 20 and of an amplified agitator 25. This movement is shown in FIGS. 1B, 1C and 1D, where the crankshaft has moved from the 0-degree position of FIG. 1A to the 90-degree position in FIG. 1B, to the 180-degree position in FIG. 1C and then to the 270-degree position in FIG. 1D. The crankshaft 15 movement causes the movement of the agitator 20 and that of an amplified agitator 25. The separator 10 may also have a second crankshaft 17 that is kinematically linked to the agitator 20 and to the amplified agitator 25.

The amplified ballistic separator 10 may also have an alignment groove 26 and an alignment pin 27 disposed therein that maintain a preset relative movement of the agitator 20 relative to the amplified agitator 25. Instead of having only one agitator and/or one amplified agitator kinematically linked to the crankshaft 15 or 17, the separator bed 12 may comprise a plurality of agitators 20 and that of a plurality of amplified agitators 25, both pluralities kinematically linked to a crankshaft 15, 17. The amplified agitator 25 may comprise a saw tooth.

FIGS. 2A-2D illustrate the movement in greater detail. FIGS. 2A, 2B, 2C and 2D show the crankshaft 15 position in the 0-, 90-, 180- and 270-degree positions respectively. The amplified agitator 25 has a total lateral displacement 35 that is larger than the crankshaft total lateral displacement 30. The amplified agitator total lateral displacement 35 may be at least 1.5 times larger than the crankshaft total lateral displacement 30. The maximal lateral displacement in either direction, for both the crankshaft displacement 30 and for the amplified agitator displacement 35, are specifically seen in FIG. 2B and FIG. 2D.

The kinematic linkage of the agitator 20 and the amplified agitator 25 to the crankshaft 15 may be achieved through a cam follower 45. The cam follower 45, which links the agitator 20 and the amplified agitator 25 to the crankshaft 15, may include a notch 47, an agitator pivot 50 connected to the agitator 20, and an amplified agitator pivot 55 connected to the amplified agitator 25. A cam 40 may be disposed of in the notch 47, and the cam 40 may be fixed relative to the movement of the crankshaft 15.

Figure 3A:
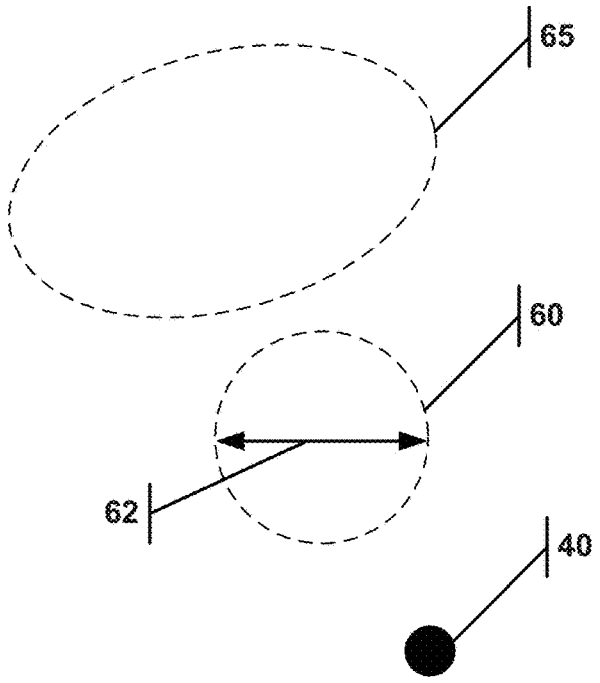
FIG. 3A illustrates the travel trace of the agitator pivot and the travel trace of the amplified agitator pivot.
Figure 3B:
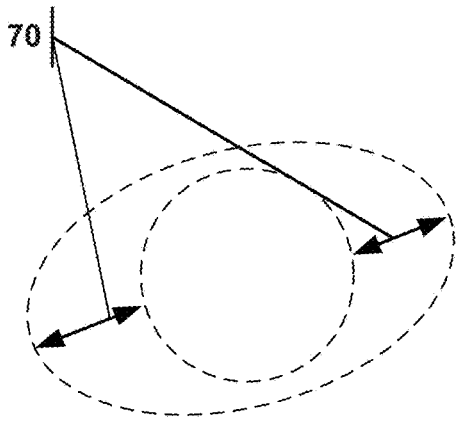
FIG. 3B illustrates the travel trace of the agitator pivot superimposed on the travel trace of the amplified agitator pivot.

FIG. 3A shows the travel trace of the agitator pivot 50 as the dashed circle 60, and the travel trace of the amplified agitator pivot 55 as the dashed oval 65. The movement of the agitator 20 would therefore trace a circle, and the amplified agitator 25 movement would therefore trace a non-circle. (It is possible, depending on the type of mechanical linkage between the agitator 20 and the amplified agitator 25, to have the amplified agitator pivot 55 trace another type of non-circle pattern besides oval.) The cam 40 is fixed relative to the movement shown by these traces. FIG. 3B shows the travel trace of the agitator pivot 60 superimposed on the travel trace of the amplified agitator pivot 65, which illustrates the amplified lateral movement of the amplified agitator relative to the agitator (arrows 70). In other words, the agitator 20 has a total lateral displacement 62 that is less than the amplified agitator total lateral displacement 35.

Figure 4B:
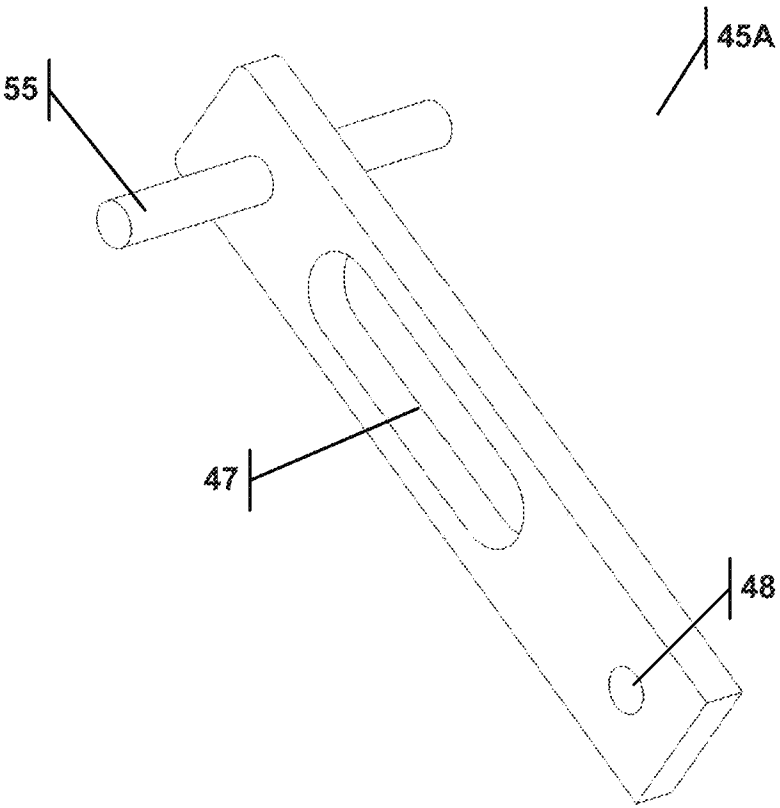
FIG. 4B illustrates an alternate embodiment of a cam follower.
Figure 4A:
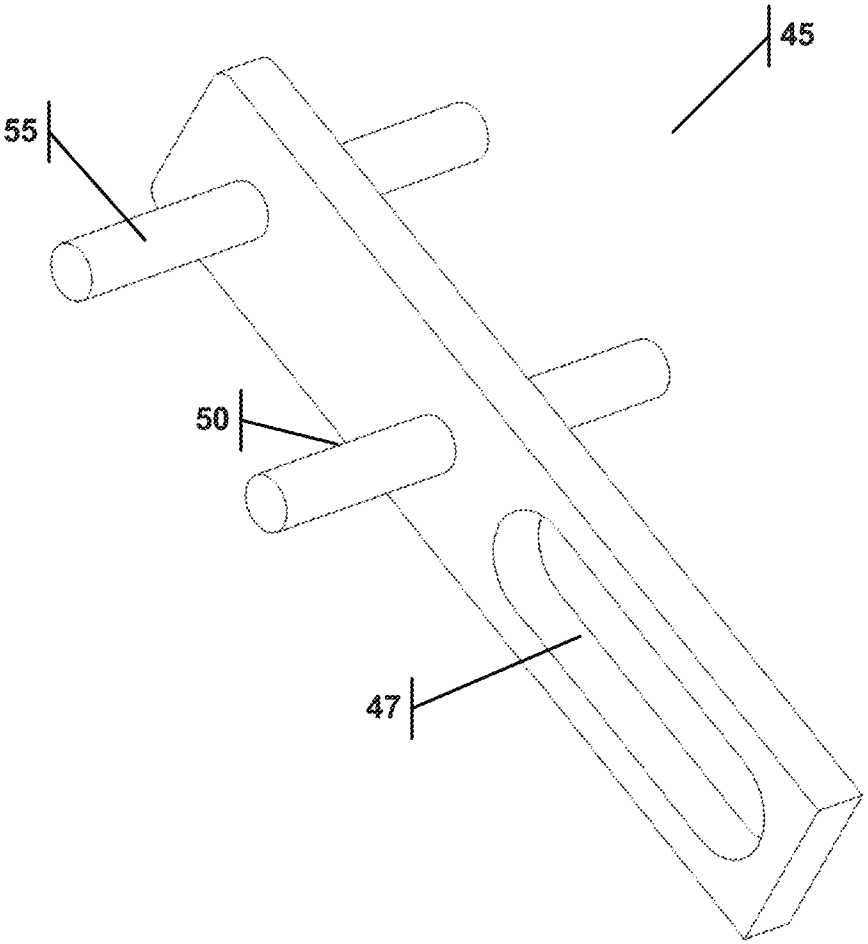
FIG. 4A illustrates an embodiment of a cam follower.
Figure 4C:
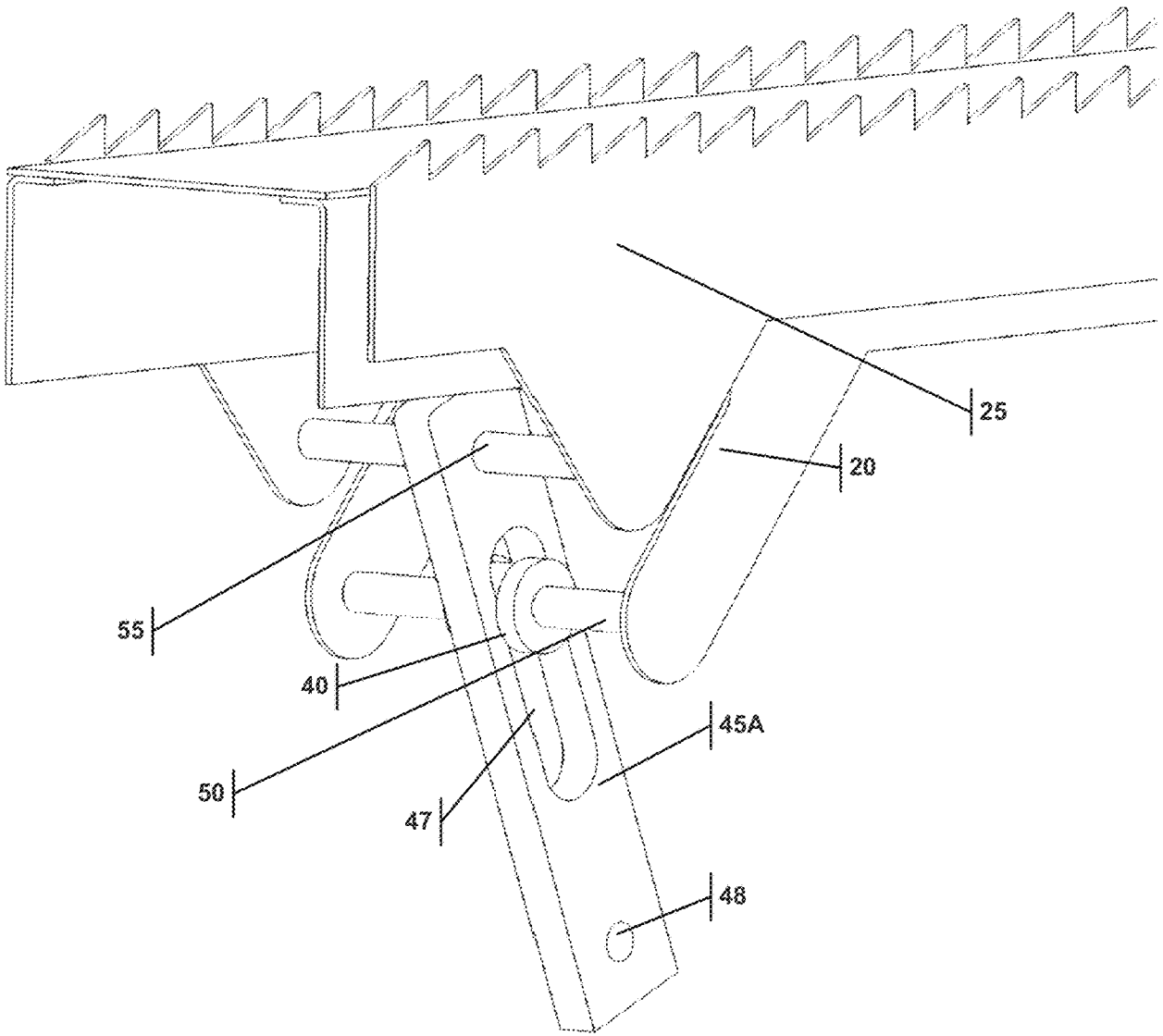
FIG. 4C illustrate the connections to the cam follower shown in FIG. 4B.

FIG. 4A illustrates the cam follower 45 previously discussed, wherein the cam follower 45 comprises a notch 47, an agitator pivot 50 connected to the agitator 20, and an amplified agitator pivot 55 connected to the amplified agitator 25. The cam 40 is disposed of in the notch 47. The cam 40 can be fixed relative to the movement of the crankshaft 15. FIG. 4B provides an alternate cam follower 45A, with a notch 47, a fixed pivot 48, and an amplified agitator pivot 55 connected to the amplified agitator 25. As shown in FIG. 4C, the cam follower 45A has a cam 40 disposed of in the notch 47, and the cam 40 is connected to the agitator 20 via the agitator pivot 50. The cam follower 45A is also connected to the amplified agitator 25 via the amplified agitator pivot 55.

Figure 5A:
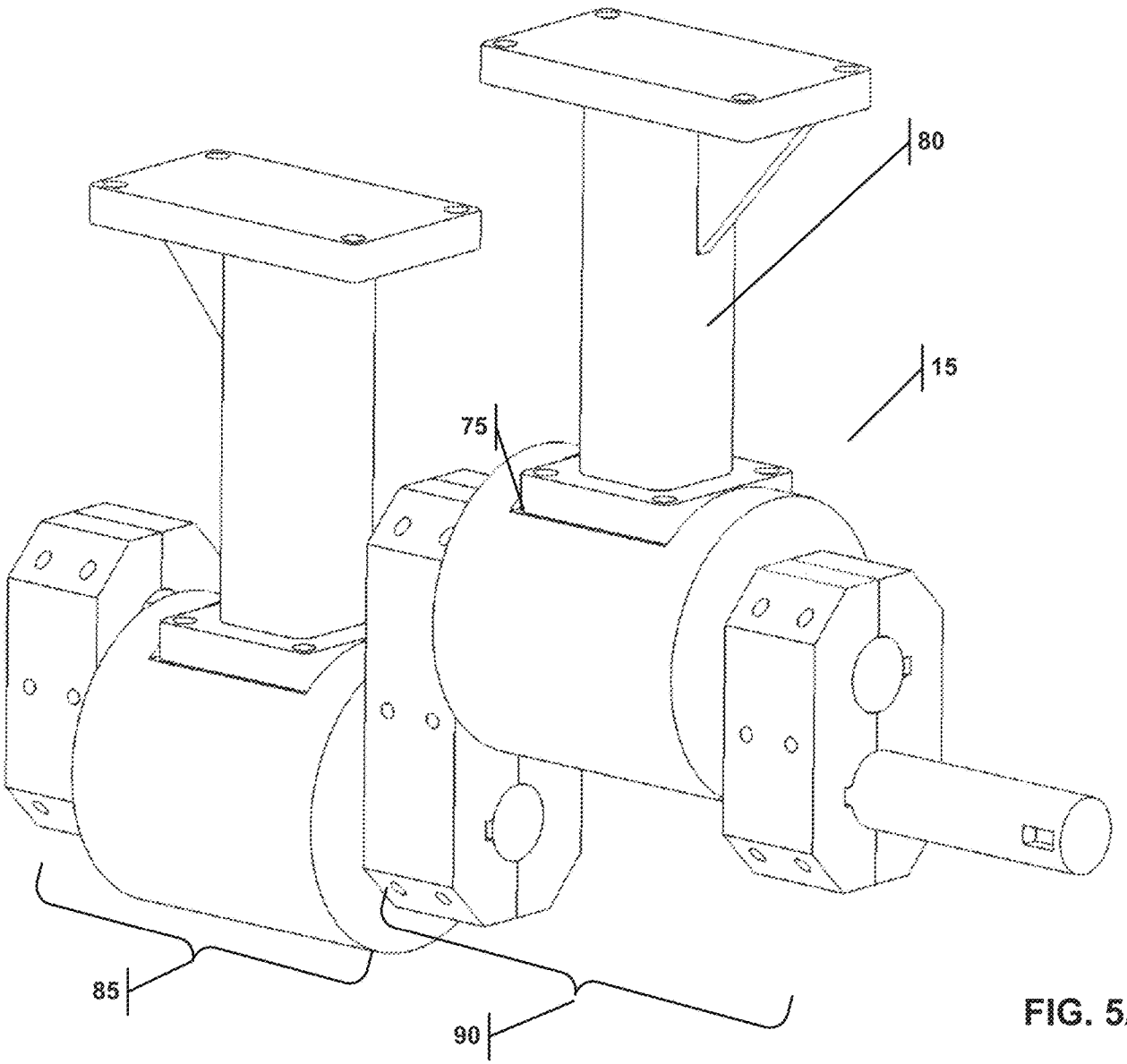
FIG. 5A illustrates the crankshaft.

FIG. 5A illustrates the crankshaft 15, which has a crankshaft saddle 75 as well as a first crankshaft phase region 85 and a second crankshaft phase region 90. These regions allow adjacent agitators to be in different rotational phases relative to each other (see FIGS. 6A, 6B, 7). The amplified ballistic separator 10 may comprise a crankshaft 15 that has multiple phase regions and adjacent amplified agitators 25 connected to different phase regions.

Figure 5B:
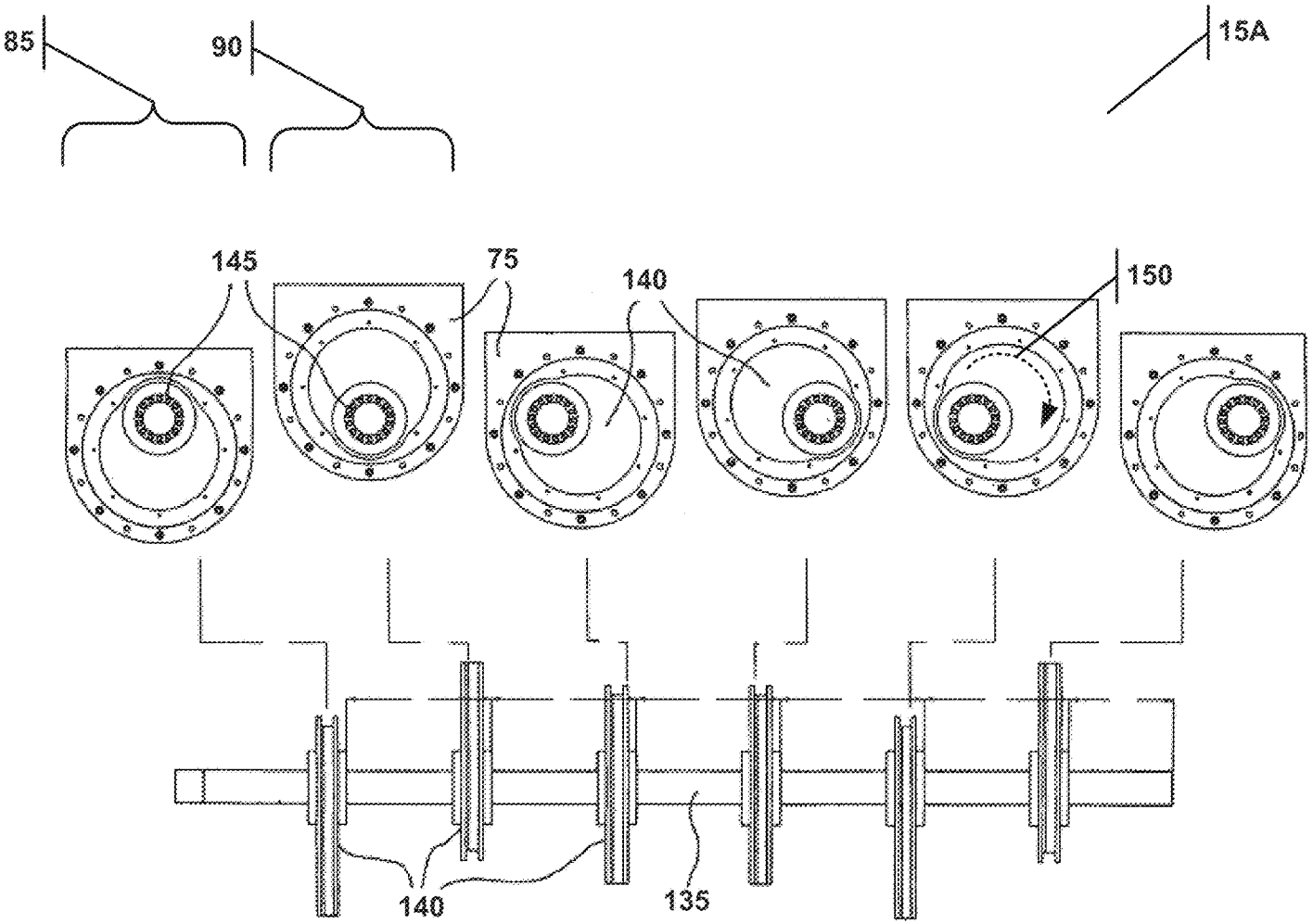
FIG. 5B illustrates a crankshaft comprised of eccentric discs.

FIG. 5B illustrates an alternate embodiment of a crankshaft 15A using eccentric discs 140 that rotate in the direction 150 relative to the crankshaft saddle 75. The eccentric discs 140 have a mount 145 that attaches to a straight shaft 135. This design is disclosed in EP1832352B1, the entire contents of which are incorporated herein by reference. However, it is the present invention that discloses the use of such a design in an improved amplified ballistics separator 10 that comprises an agitator 20, an amplified agitator 25, and a crankshaft 15 kinematically linked to the agitator 20 and the amplified agitator 25, such that the amplified agitator total lateral displacement 35 is large than the crankshaft total lateral displacement 30, irrespective of the structure of the crankshaft 15.

Figure 6A:
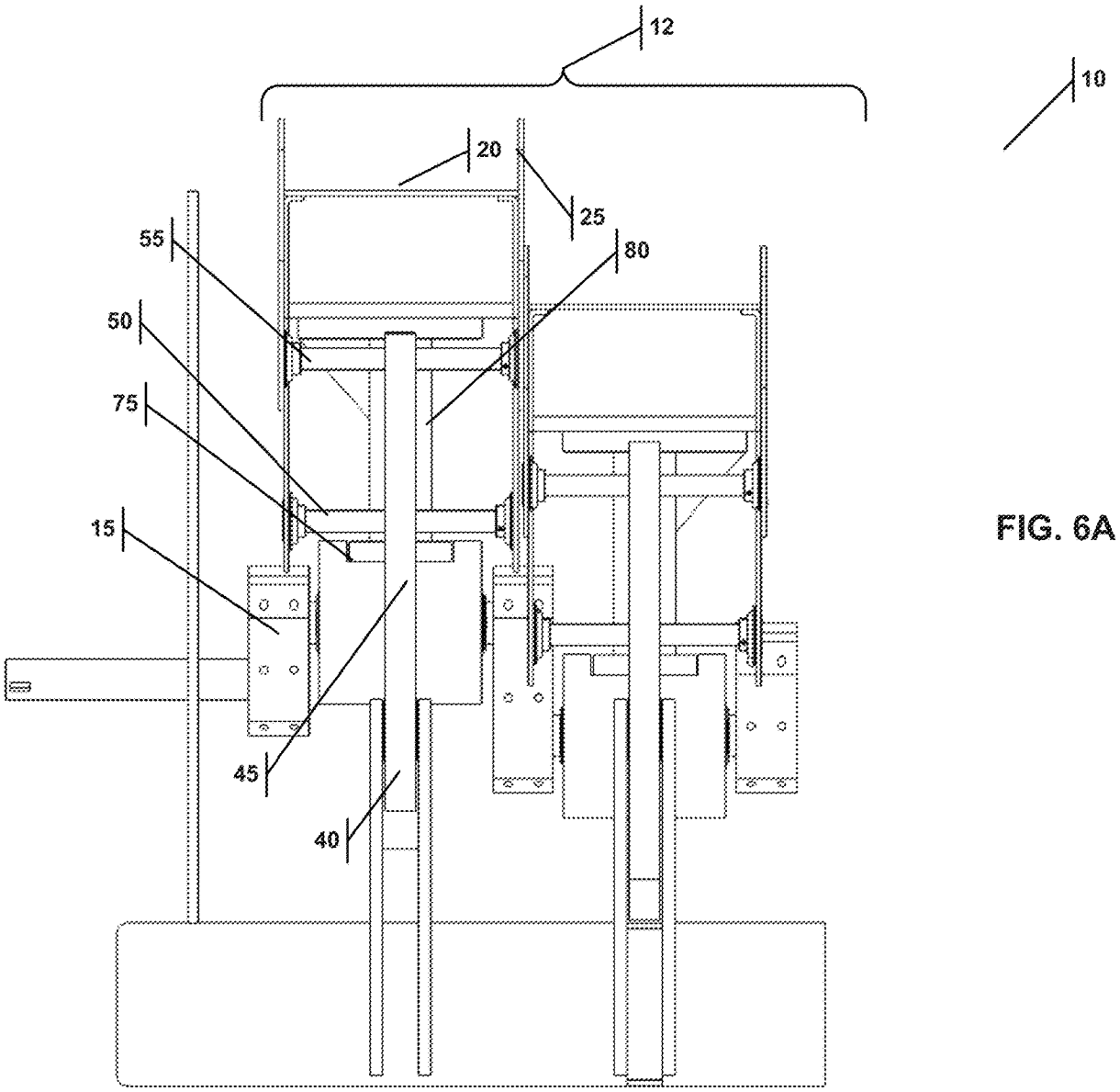
FIG. 6A is a front view of a novel amplified ballistic separator, with two adjacent agitators and amplified agitators out of phase.
Figure 6B:
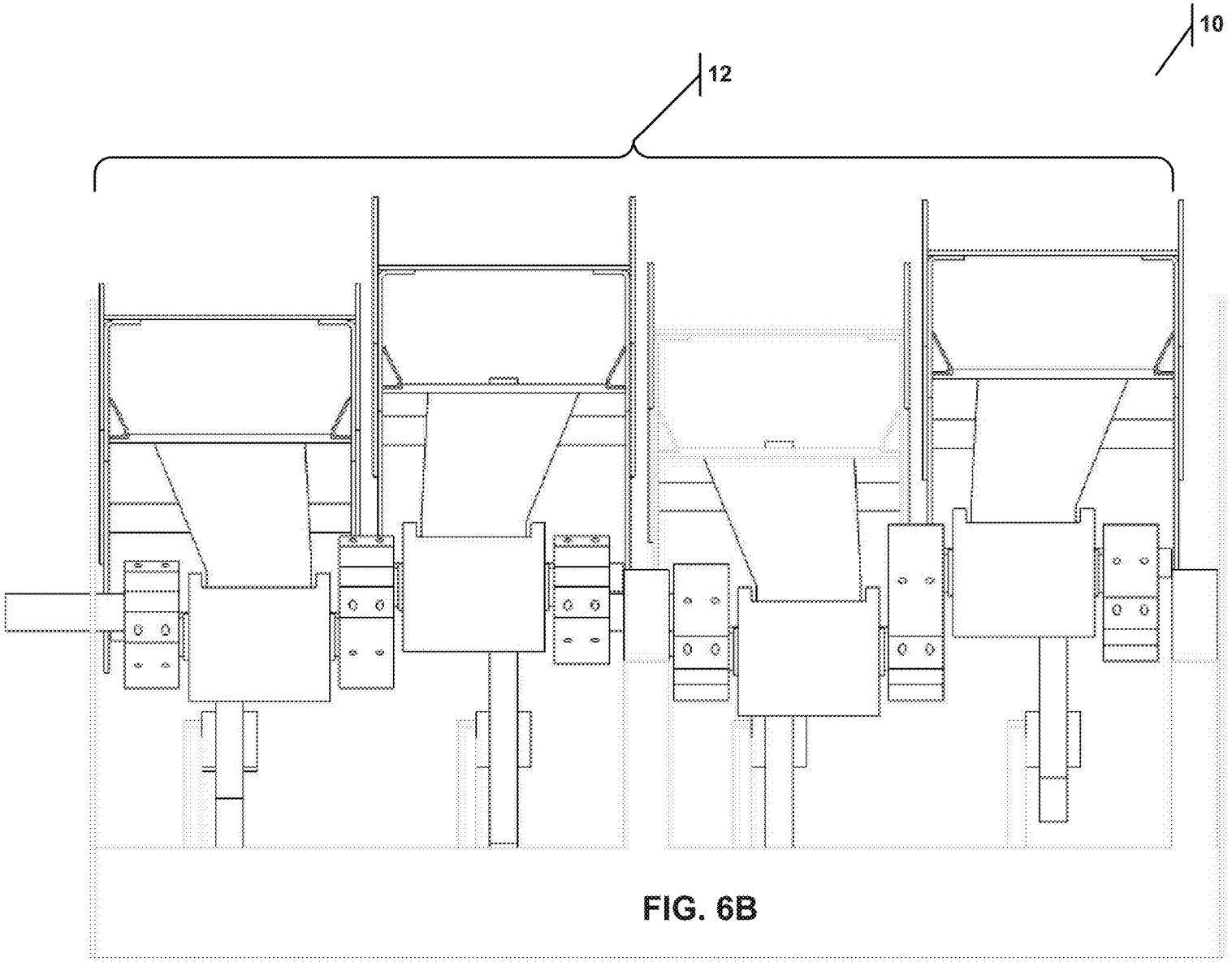
FIG. 6B is a front view of a novel amplified ballistic separator, with four adjacent agitators and amplified agitators out of phase.

FIGS. 6A and 6B illustrate a front view of a plurality of adjacent of agitators 20 and a plurality of amplified agitators 25 kinematically linked to the crankshaft 15. The crankshaft 15 has multiple phase regions (85, 90), and the adjacent amplified agitators 25 may be connected to different phase regions. Actually, the crankshaft shown in FIG. 6B has four different phase regions.

Figure 7:
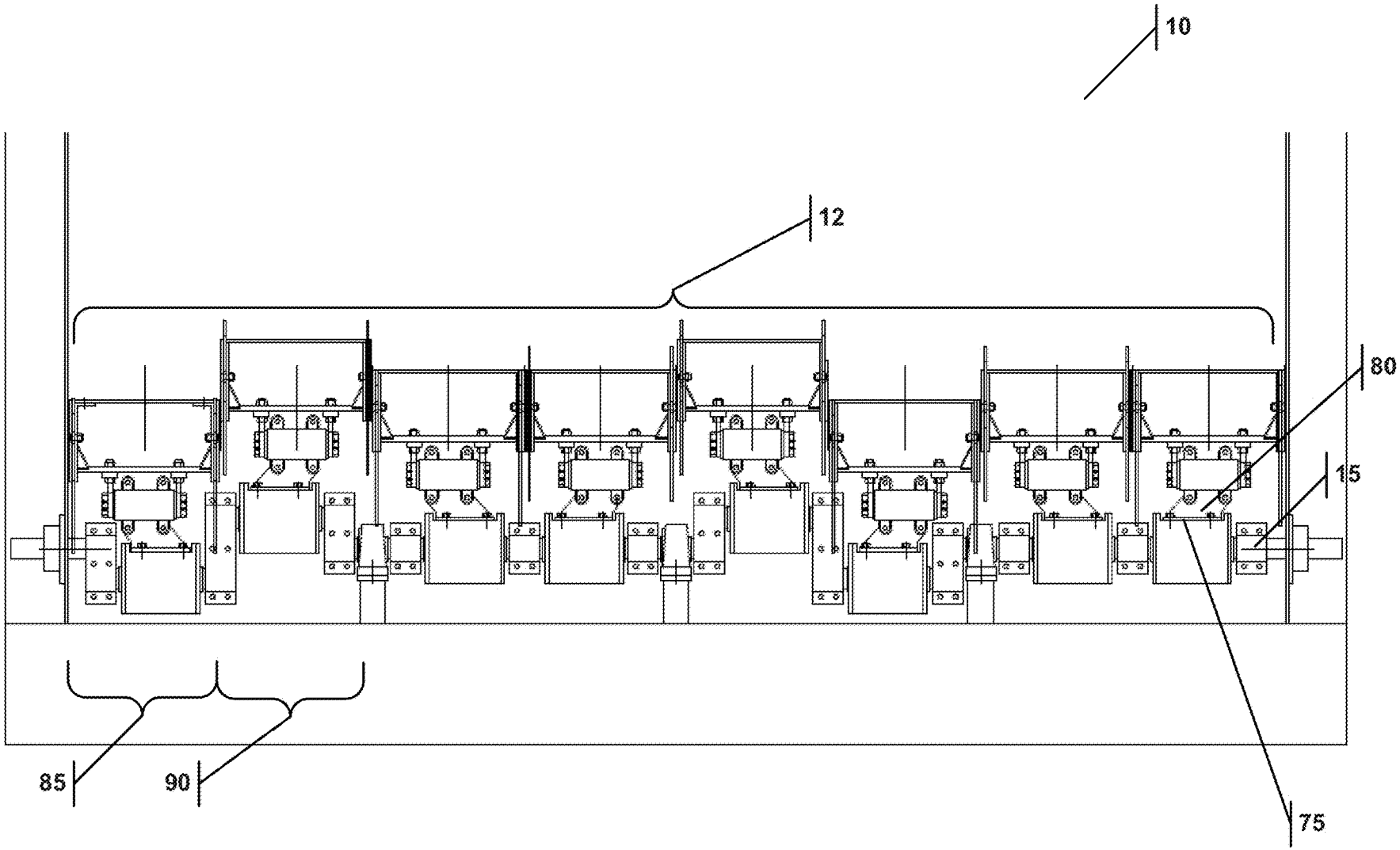
FIG. 7 is a front view of a novel amplified ballistic separator, with adjacent agitators and amplified agitators out of phase.
Figure 8:
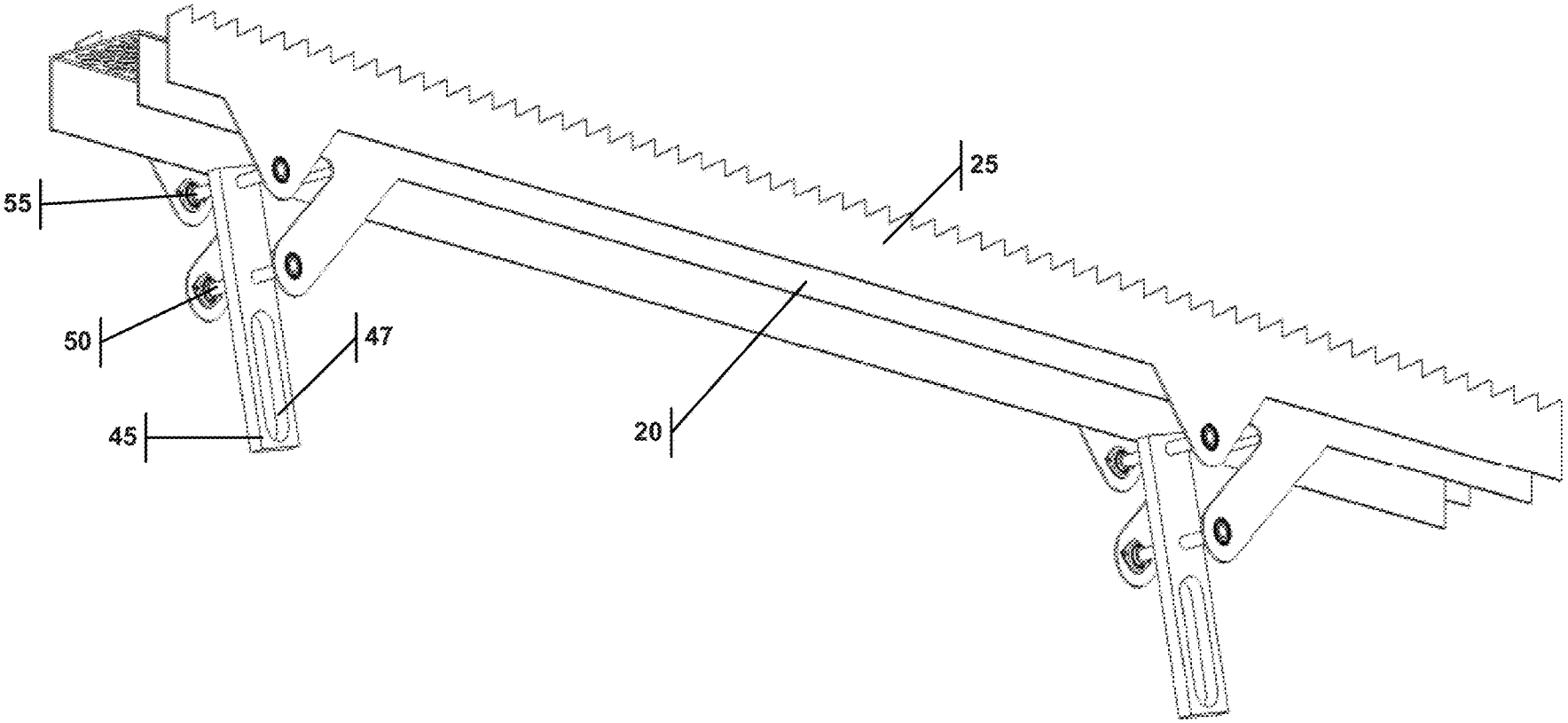
FIG. 8 is a bottom perspective view of the connections between the cam follower, agitator and amplified agitator.

FIG. 7 shows that the crankshaft 15 of the amplified ballistic separator 10 may have a plurality of phase regions, more than the two or four phase regions illustrated in FIGS. 6A and 6B, and may have a plurality of agitators 20 and amplified agitators 25 connected to the crankshaft 15, where adjacent agitators are out of phase with one another. FIG. 8 then shows the bottom perspective view of the connections between the cam follower 45, agitator 20 and amplified agitator 25. Whereas the prior art has only a single agitator with cleats to contact flat material and to propel flat material forward on an inclined plane, the present invention employs both an agitator 20 and an amplified agitator 25. As shown in FIGS. 8-11, the agitator 20 is shaped as a paddle, and the amplified agitator 25 is comprised of a saw tooth, and the saw tooth would contact and would lift the flat material. It is logical and advantageous for the saw tooth to be on the amplified agitator 25, since the amplified agitator total lateral displacement 35 is generally greater than the agitator total lateral displacement of 62, illustrated in FIGS. 3A and 3B. In practical terms, this means that for each cycle of the crankshaft 15 movement, the amplified agitator 25 that engages the flat material with the saw tooth would move that material further up the ballistic separator bed 12.

Figure 9:
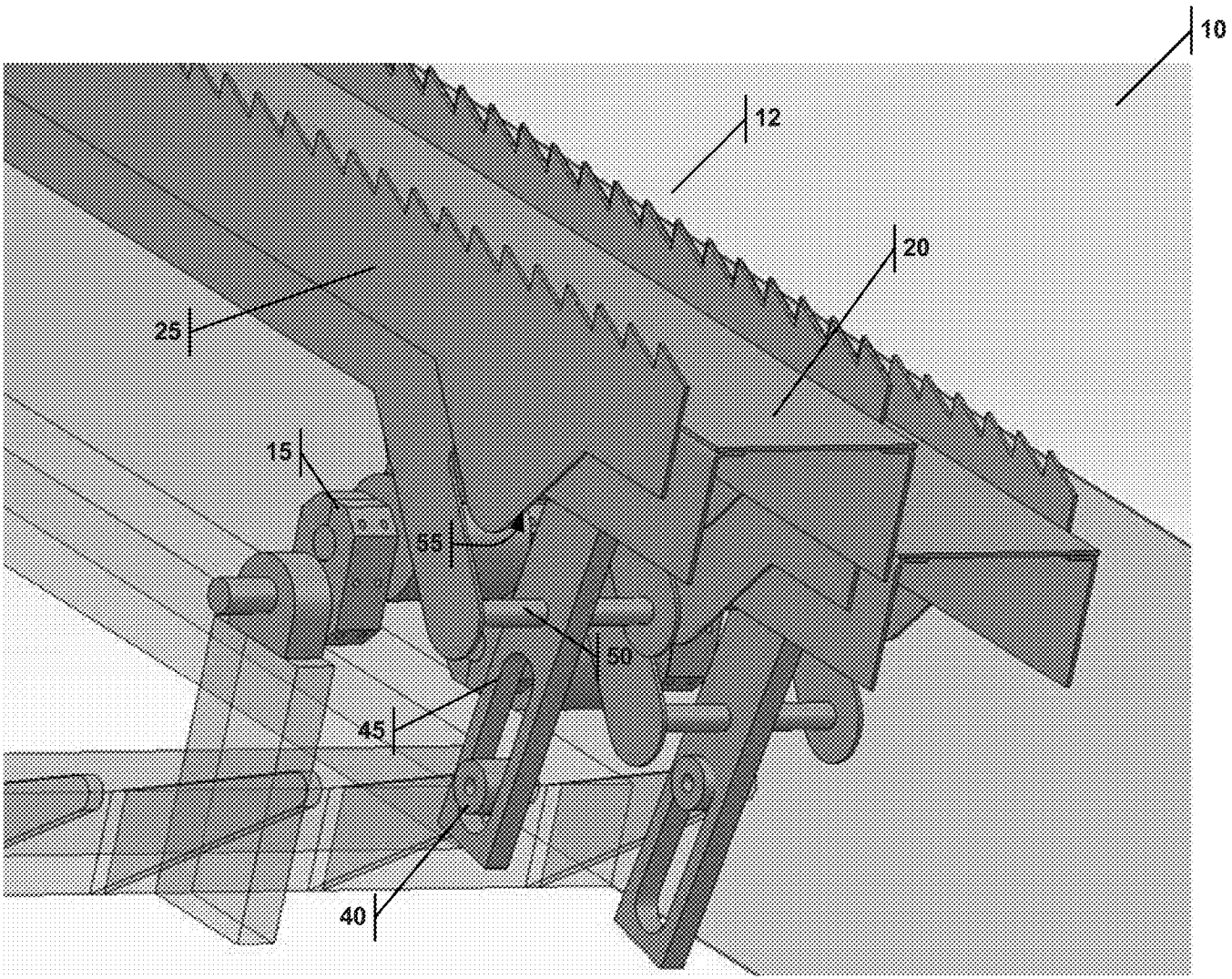
FIG. 9 is a top perspective view of the connections between the cam follower, agitator, amplified agitator and cam shaft.
Figure 10A:
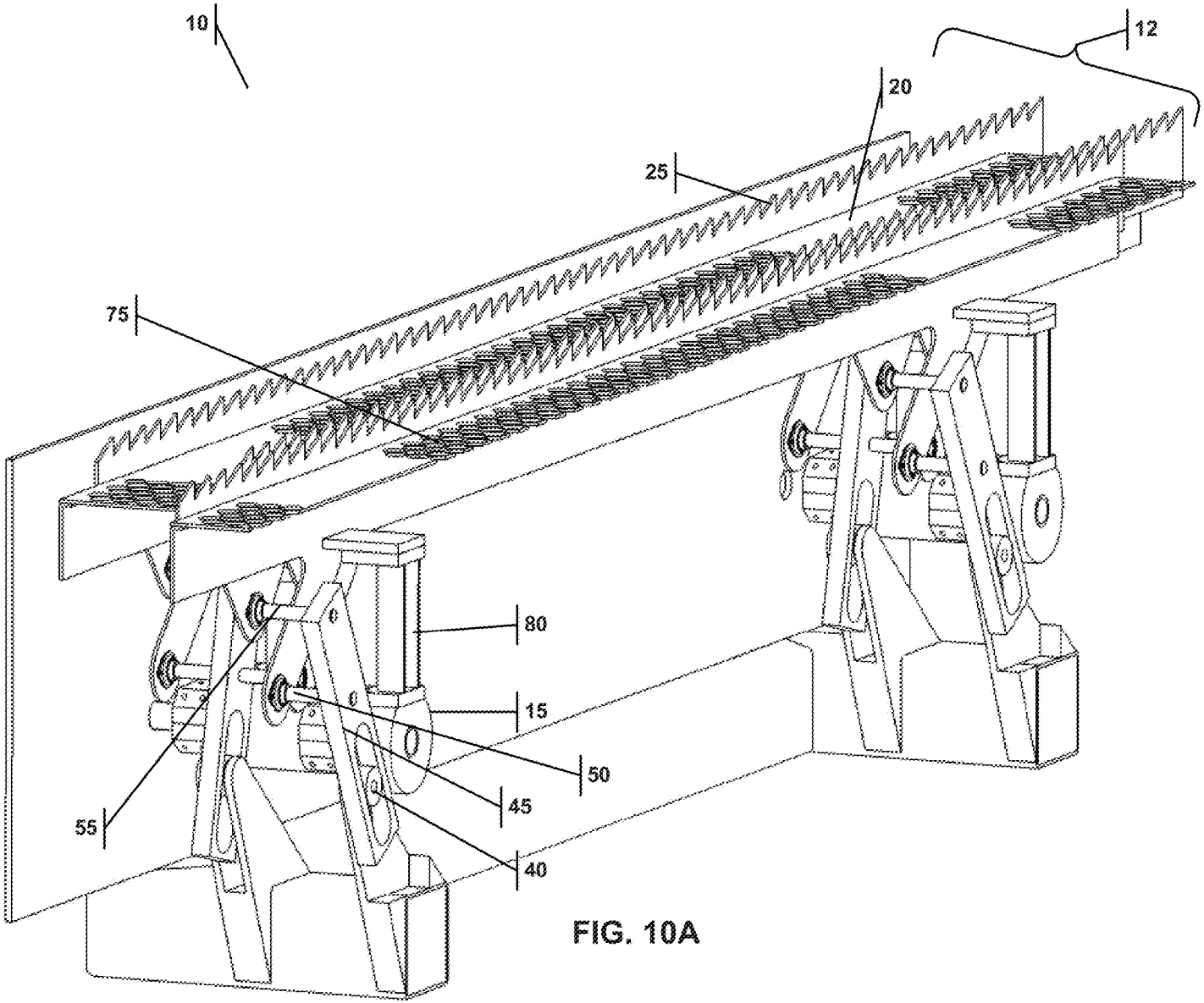
FIG. 10A is a front perspective view of the connections between the cam follower, agitator, amplified agitator and cam shaft.
Figure 10B:
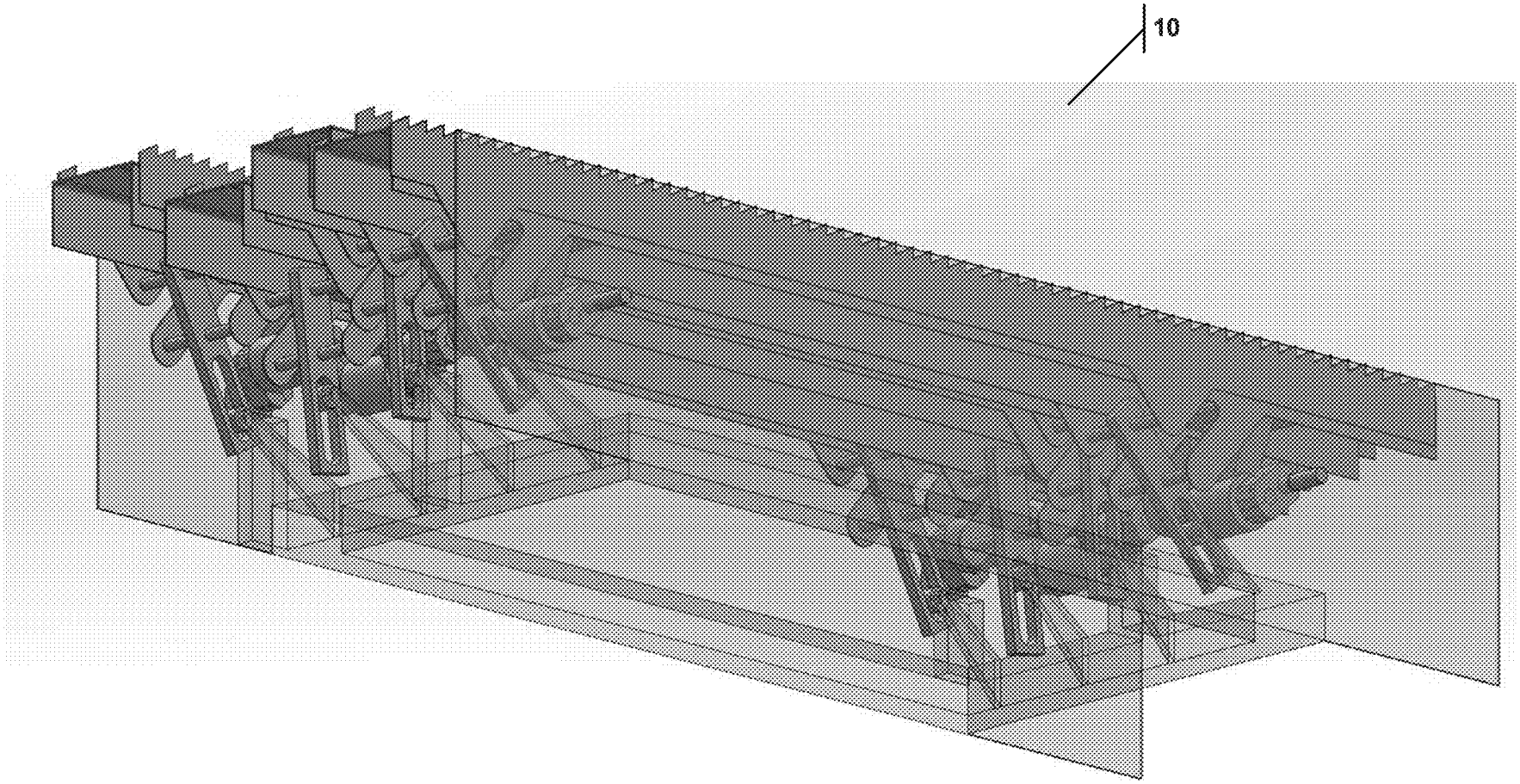
FIG. 10B is a side perspective view of a novel amplified ballistic separator, with four adjacent agitators and amplified agitators out of phase.
Figure 11A:
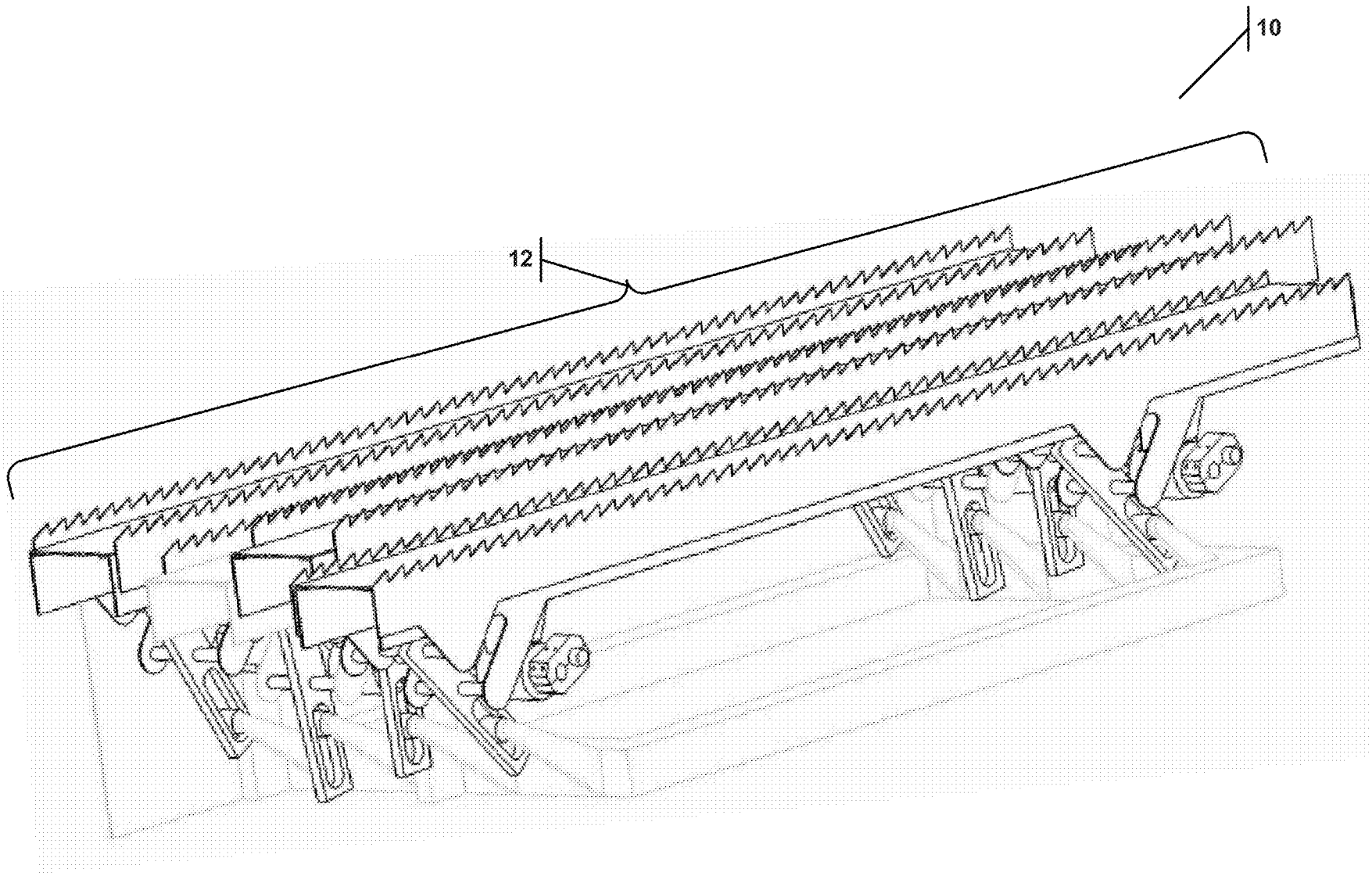
FIG. 11A is a top perspective view of a novel amplified ballistic separator with two adjacent agitators and amplified agitators.
Figure 11B:
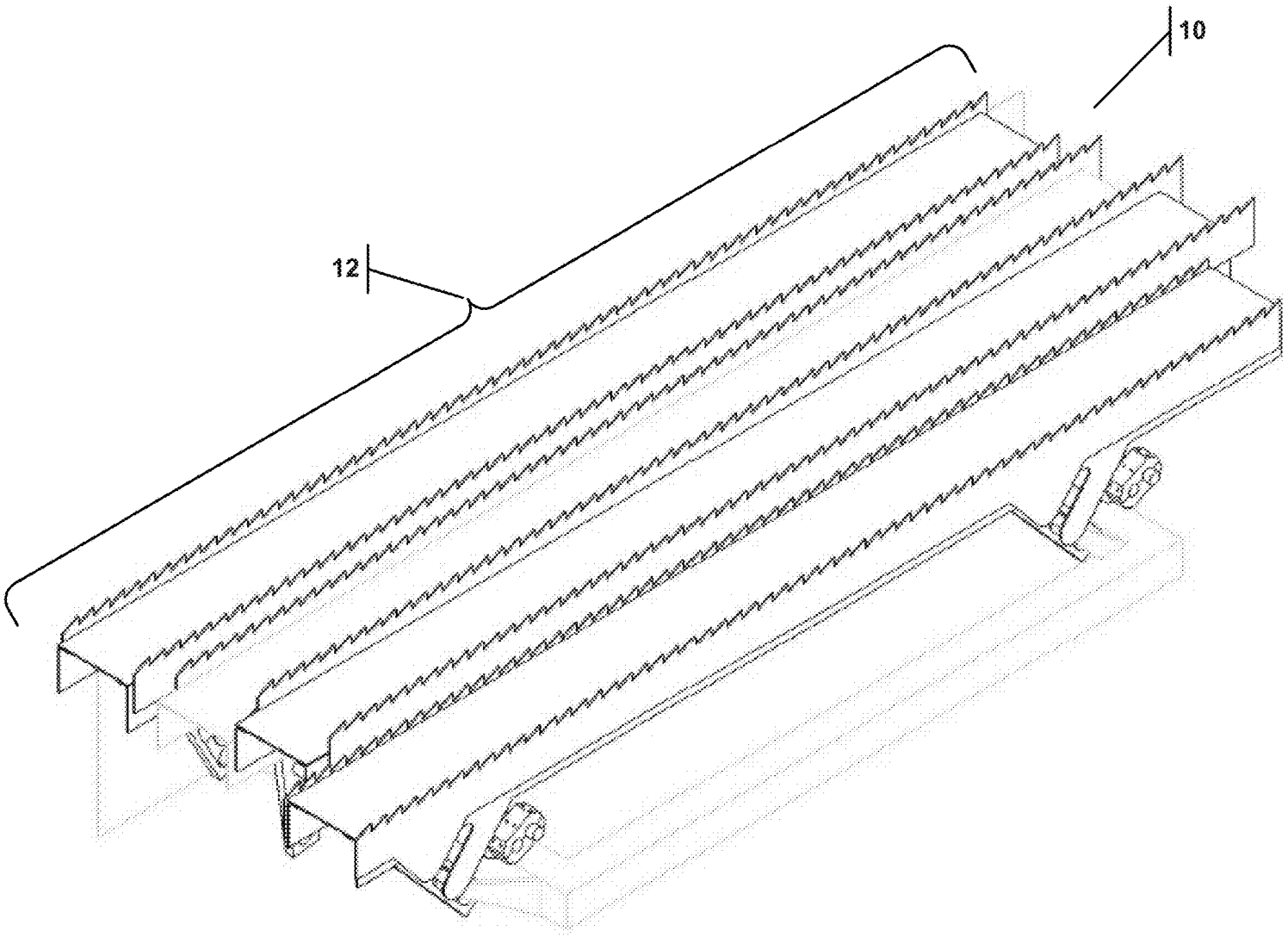
FIG. 11B is a top perspective view of a novel amplified ballistic separator with four adjacent agitators and amplified agitators.
Figure 12:
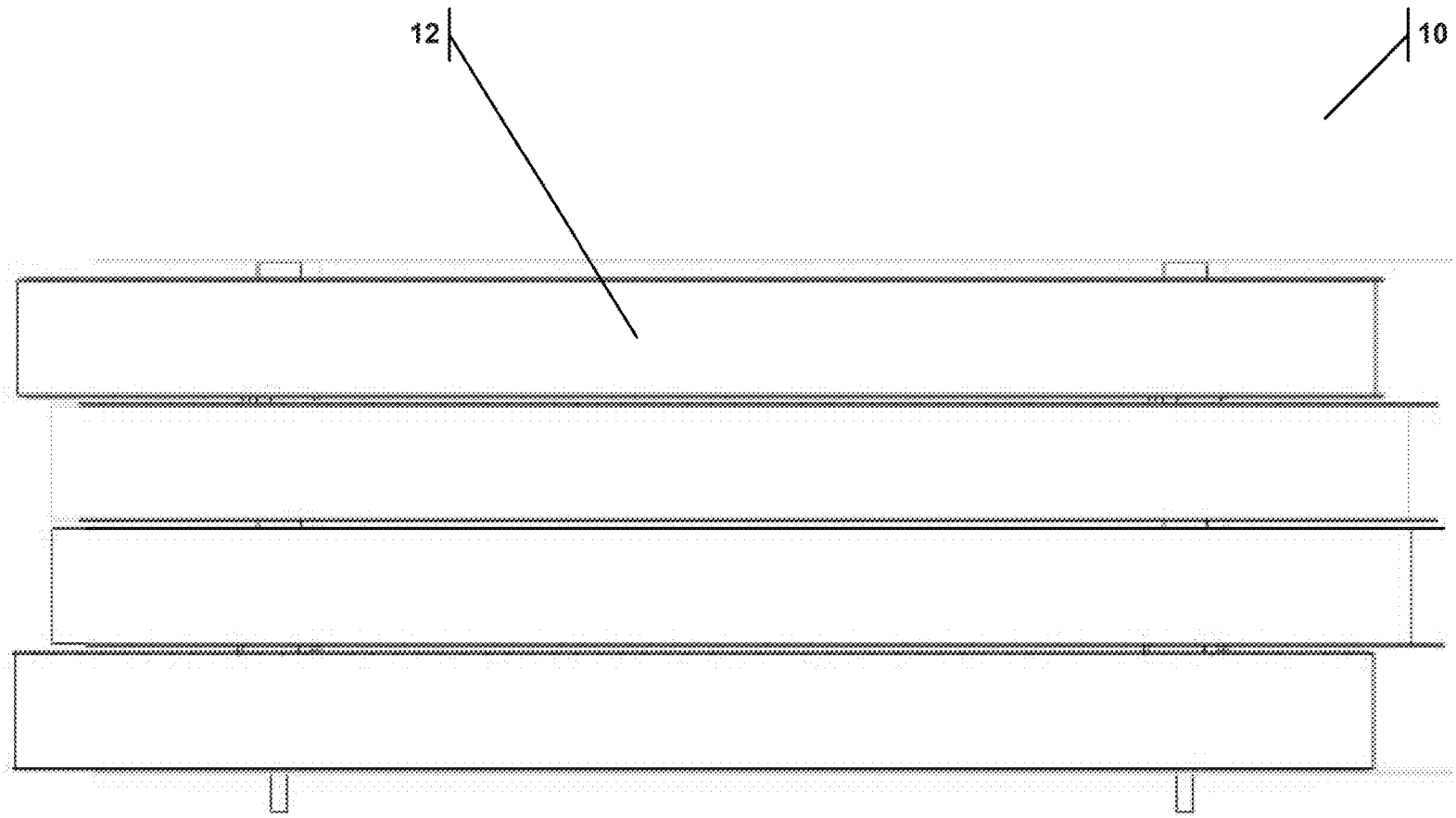
FIG. 12 is a top view of a novel amplified ballistic separator bed, with the separator comprised of four adjacent agitators and amplified agitators.

FIG. 9 shows a top perspective view of two adjacent agitators 20, each connected to a different phase region of the crankshaft 15. In this view, the agitator pivot 50 is visible, while the amplified agitator pivot 55 located further up the cam follower 45 is hidden, located on the inside of the amplified agitator 25. FIG. 10A then shows the front perspective view, in which the amplified agitator pivot 55 is visible, and the agitator connection structure 80 is shown. The agitator connection structure 80 connects the agitators to the crankshaft saddle 75. FIG. 10B shows the bottom perspective view of a separator 10 where there are four phase regions of the crankshaft, and a plurality of agitators and amplified agitators, wherein adjacent agitators are out of phase with one another. This out-of-phase feature of adjacent agitators is an important point of distinction and improvement over the prior art, as it further improves the separation of diverse materials. FIGS. 11A and 11B present further top perspective views to provide a further visualization of the two adjacent agitators setup and the four adjacent agitators setup, respectively, and correspond to the front views of FIGS. 6A and 6B. Finally, FIG. 12 provides a top perspective view showing four adjacent agitators.

Figure 13A:
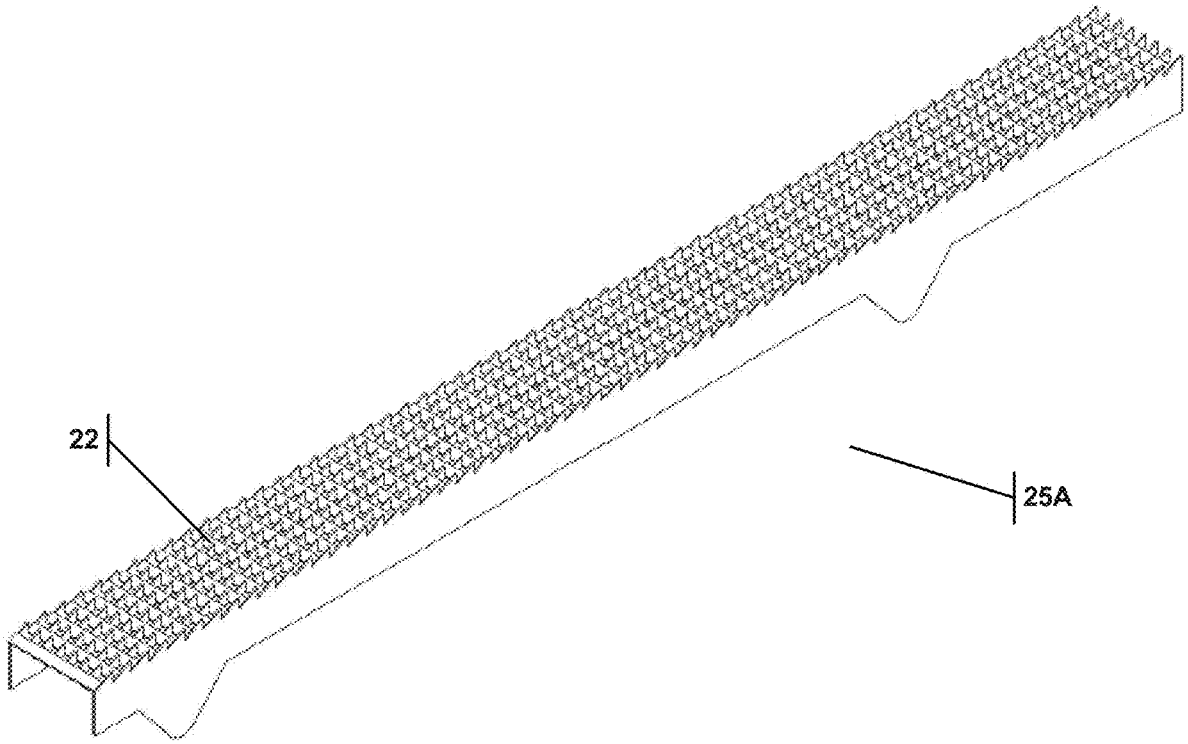
FIG. 13A is a top perspective view of an amplified agitator that wraps around the agitator.
Figure 13B:
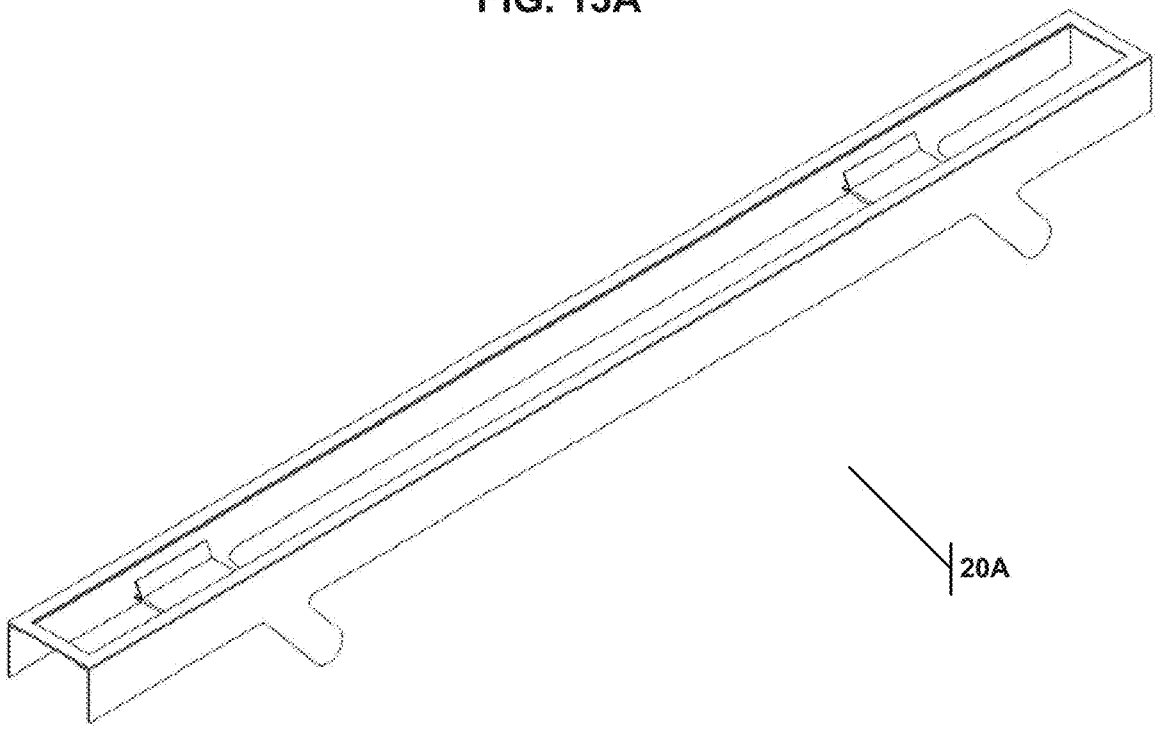
FIG. 13B is a top perspective view of an agitator used in conjunction with the wrap-around amplified agitator of FIG. 13A.
Figure 13C:
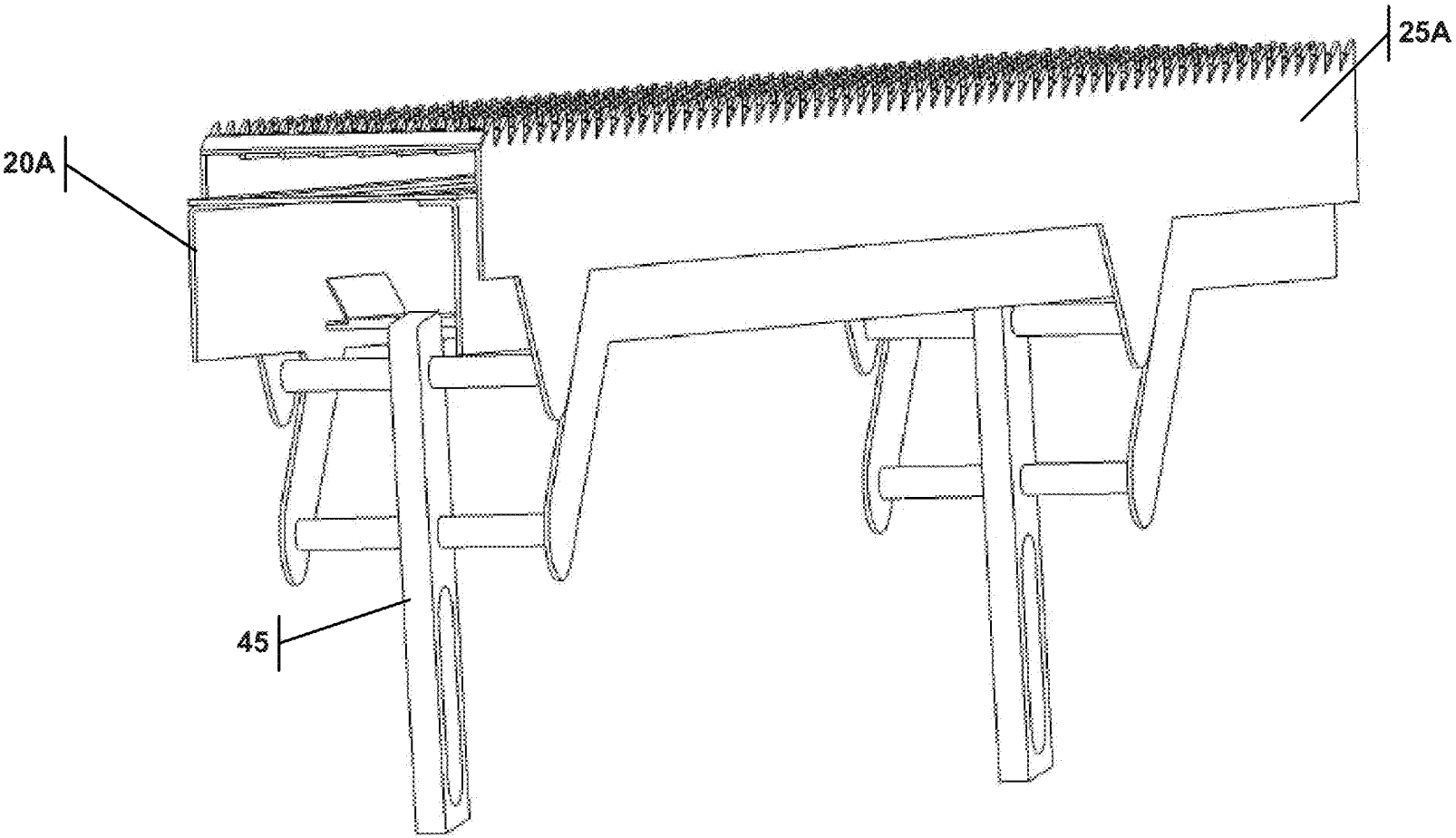
FIG. 13C is a front perspective view of the wrap-around amplified agitator installed over the agitator.
Figure 13D:
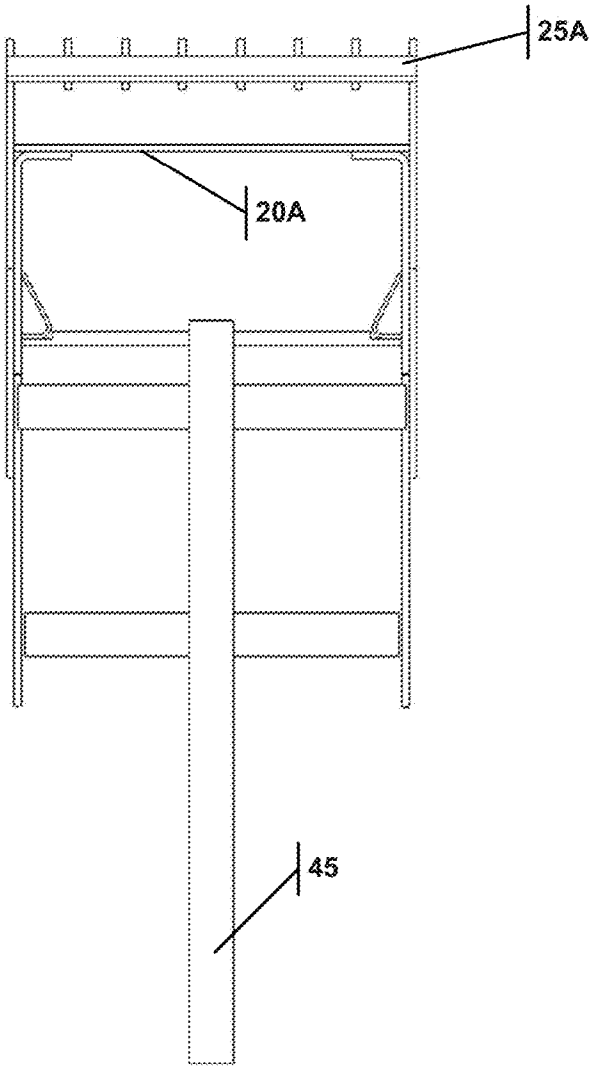
FIG. 13D is a front view of the wrap-around amplified agitator installed over the agitator.

FIGS. 13A-14B illustrate another embodiment of the separator 10, wherein the amplified agitator 25A wraps around the agitator 20A. FIG. 13A shows an amplified agitator 25A with many perforations 22 and many rows of saw tooth that is constructed to wrap around the agitator 20A, which is shown in FIG. 13B. The agitator 20A has a long cutout along its length, so that material of a certain size can fall from the top of the amplified agitator 25A through the perforations 22 and through the agitator 20A, or in other words, through the separator bed 12. As shown in FIGS. 13C and 13D, the front perspective and front views, respectively, the wrap-around amplified agitator 25A fits on top of the agitator 20A and wraps around the agitator 20A. As the lateral total displacement 35 of the amplified agitator 25A is greater, the throughput rate of this separator 10 compared to prior art will be greater, improving efficiency.

Figure 13E:
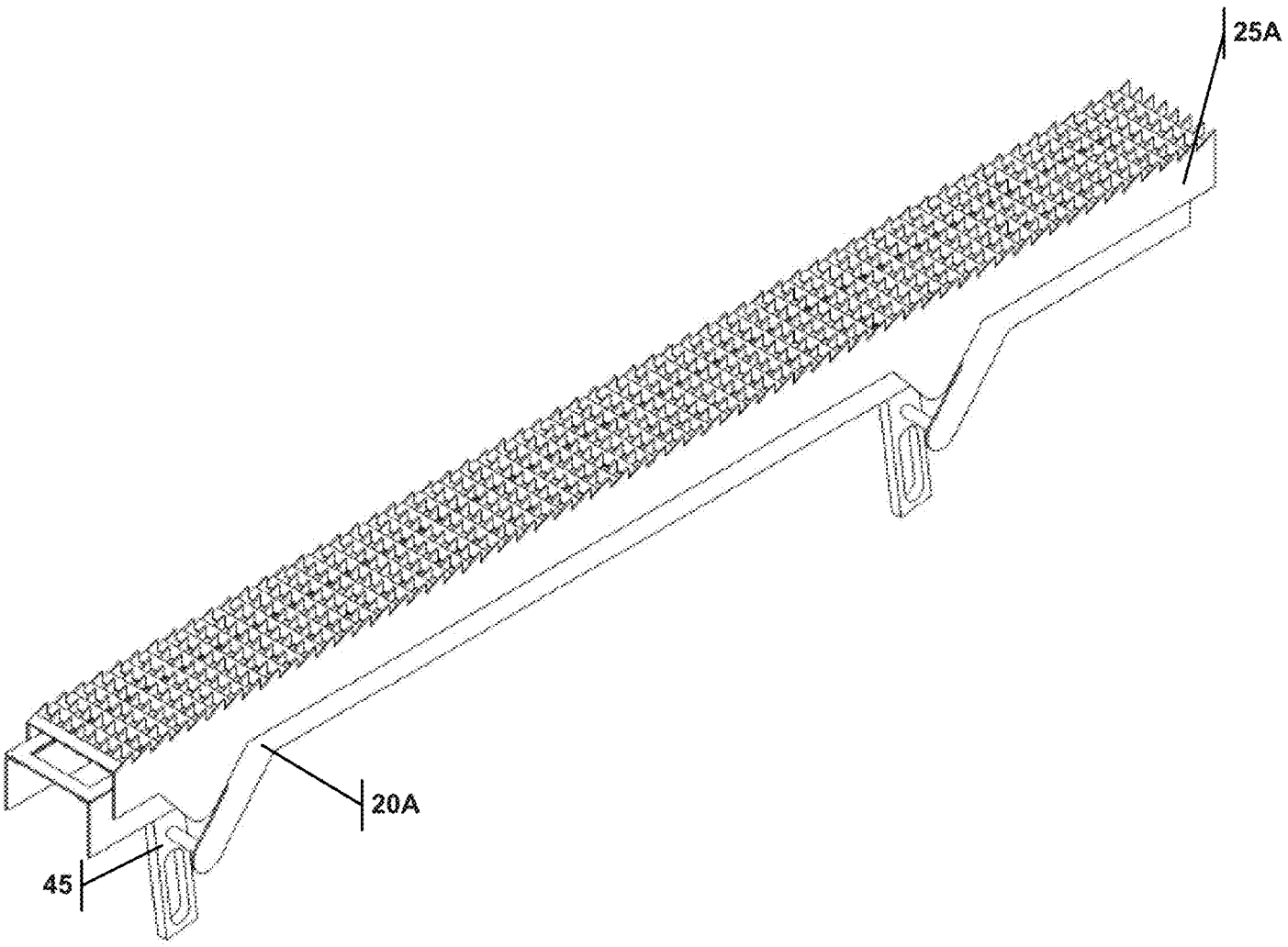
FIG. 13E is a top perspective view of the wrap-around amplified agitator installed over the agitator.
Figure 13F:
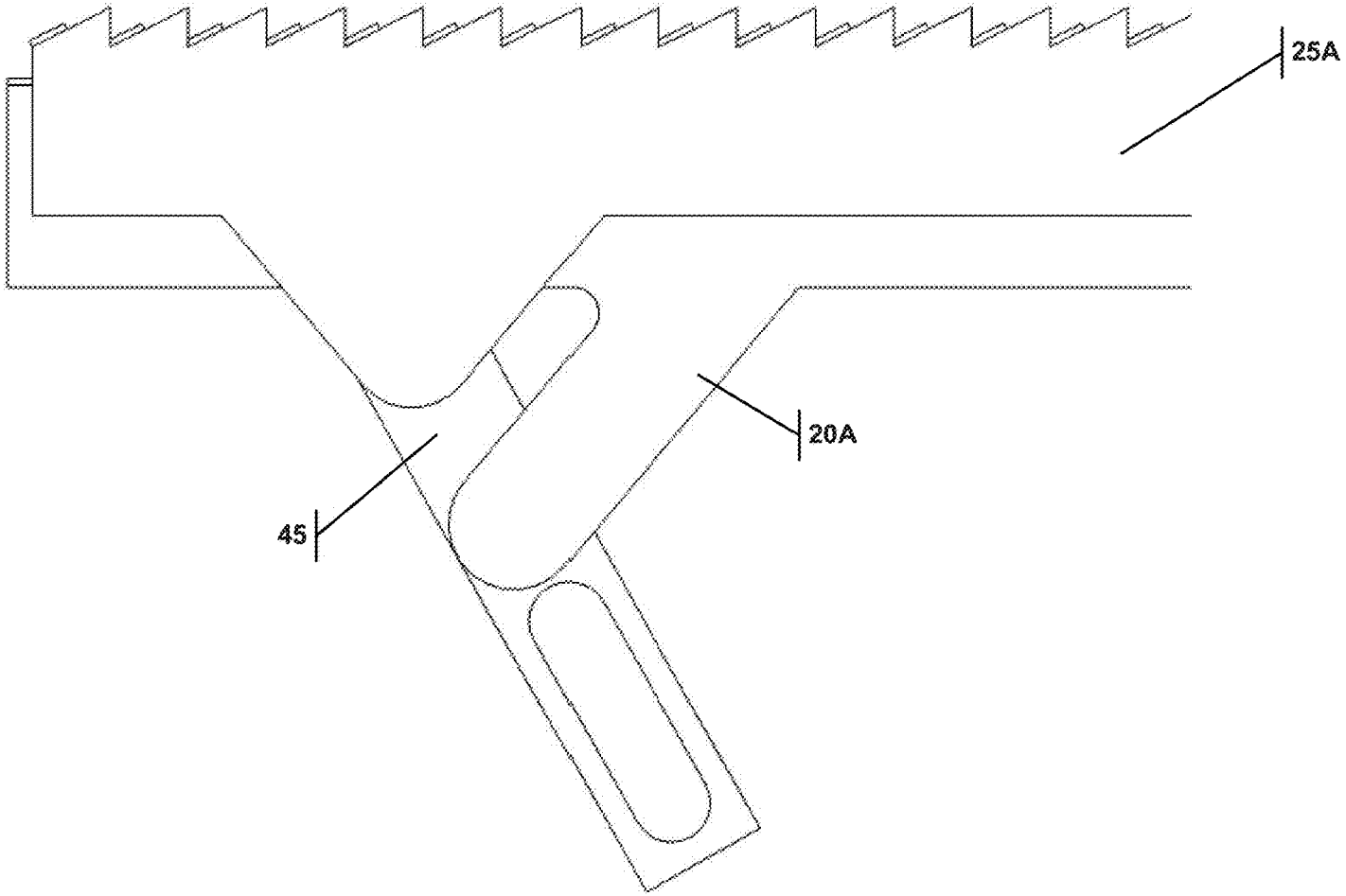
FIG. 13F is a side view of the wrap-around amplified agitator installed over the agitator.
Figure 14A:
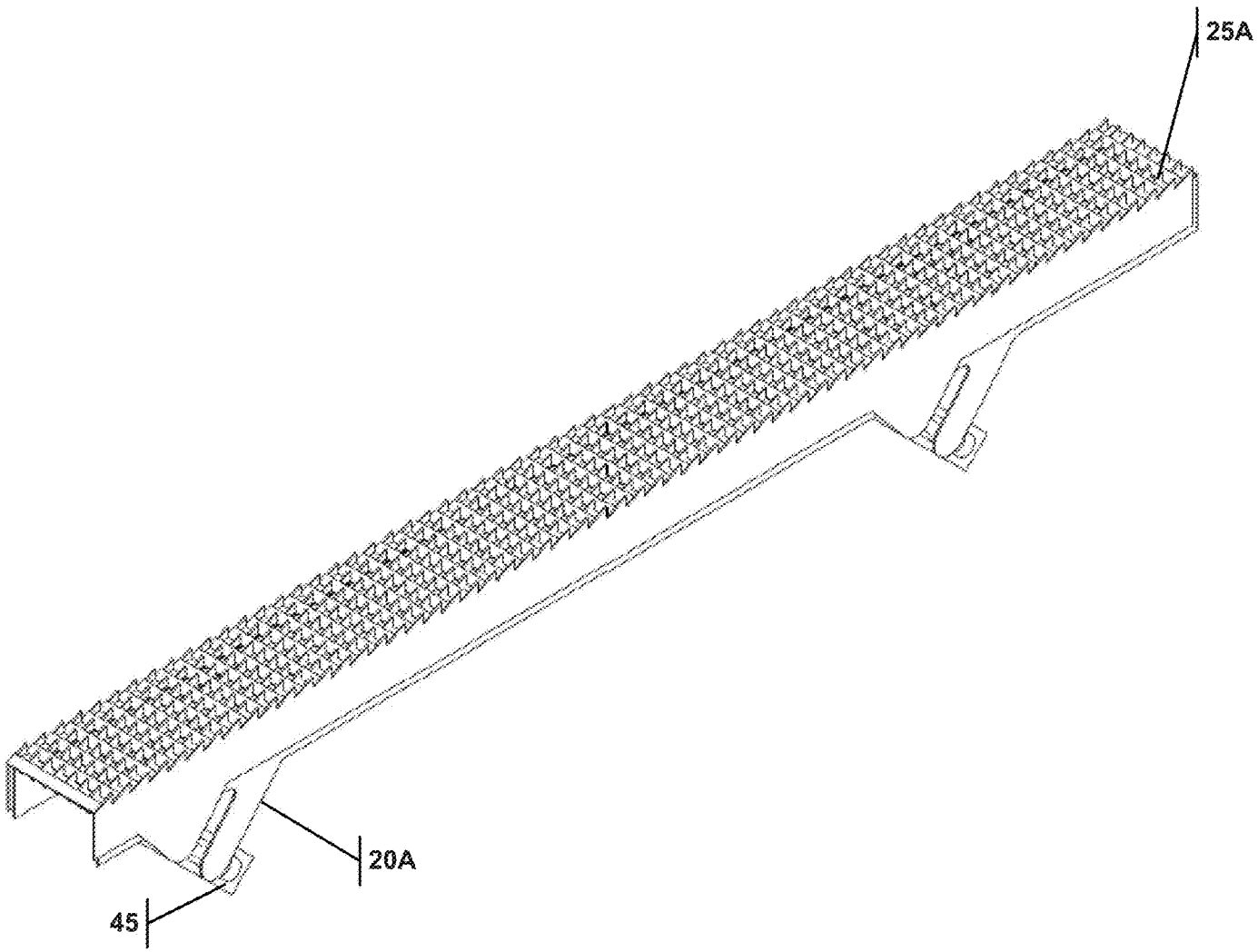
FIG. 14A is a top perspective view of the wrap-around amplified agitator installed over the agitator, using the alternate cam follower.
Figure 14B:
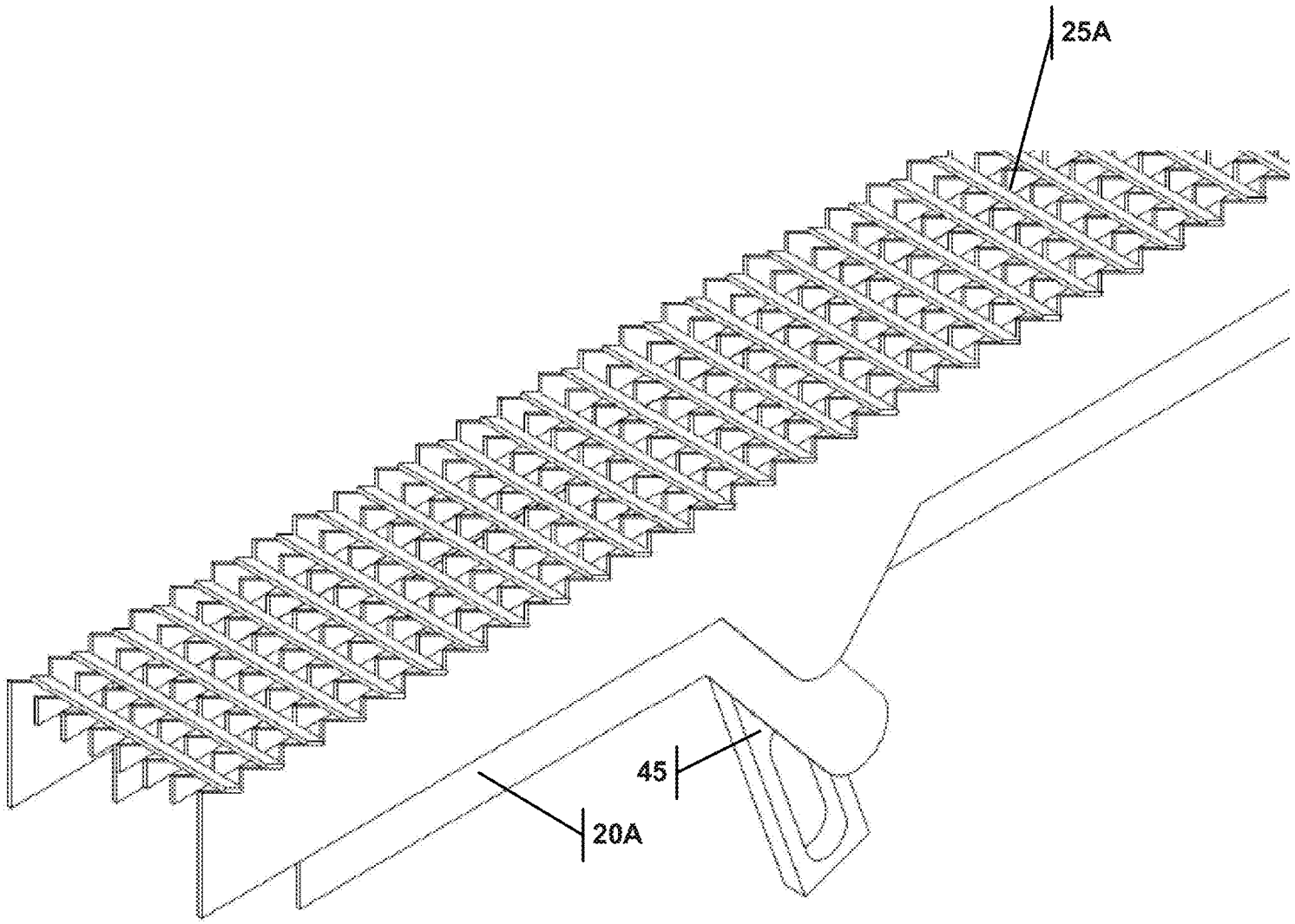
FIG. 14B is a top perspective view of the wrap-around amplified agitator installed over the agitator, using the alternate cam follower.

FIG. 13E illustrates the agitator 20A and the amplified agitator 25A fitted together. FIG. 13F shows the side view of the amplified agitator 25A fitted to the agitator 20A, and both are connected to the cam follower 45, as FIGS. 13C-F all illustrate. Whereas FIGS. 13A-F show the agitator 20A and the amplified agitator 25A connected to the cam follower 45 of FIG. 4A, which had both an amplified agitator pivot 55 and an agitator pivot 50, FIG. 14 show the wrap-around amplified agitator 25A and agitator 20A connected to the other version of the cam follower 45A, shown in FIG. 4B. Here, the amplified agitator 25A is connected to the cam follower 45A via a pivot, but the agitator 20A is connected through the cam follower notch 47.

Figure 15:
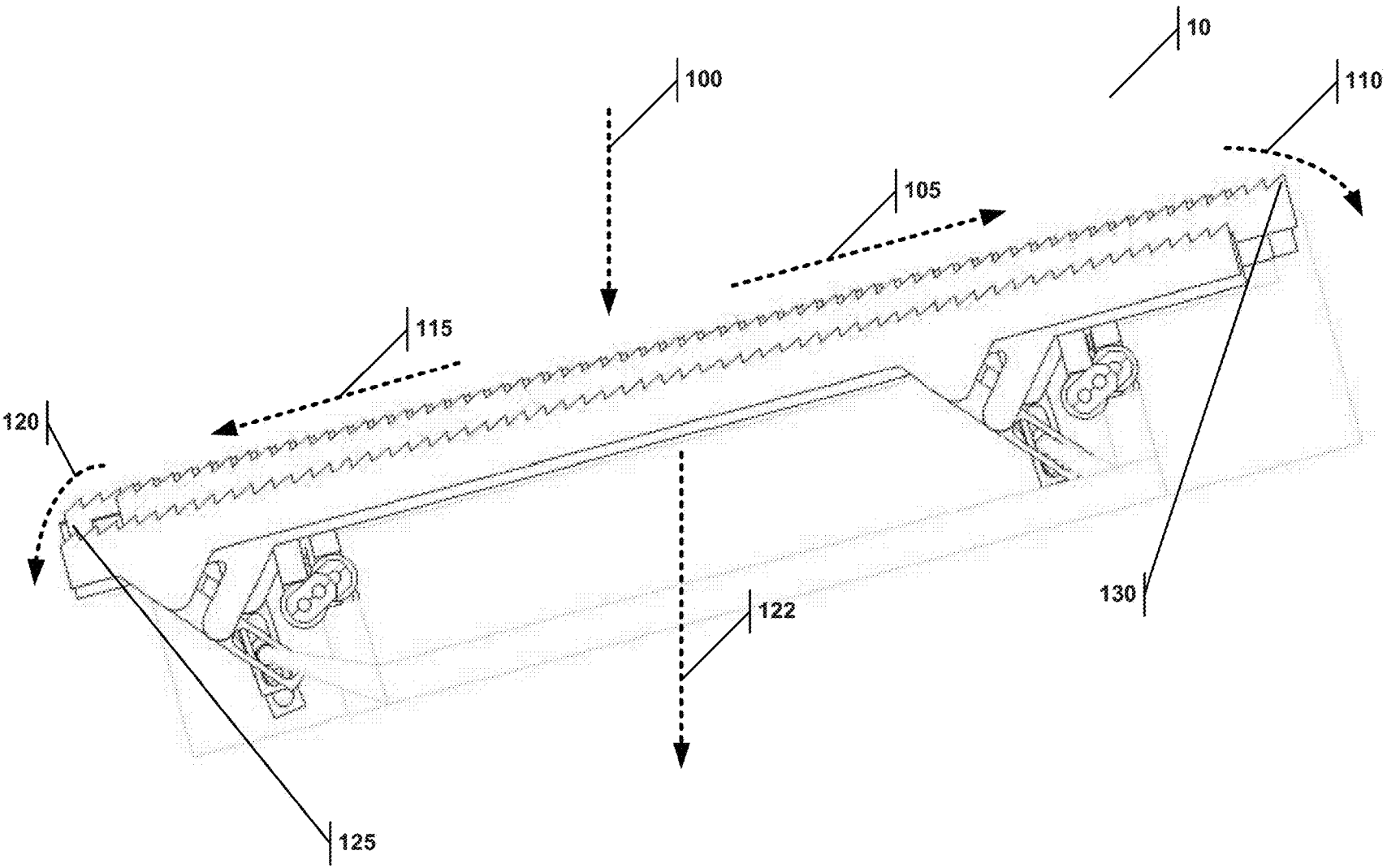
FIG. 15 is a side view of a novel amplified ballistic separator showing the incline of the bed and the separation of mix material into a plurality of fractions.

FIG. 15 shows that the separator bed 12 of the amplified ballistic separator 10 may be inclined and may have a lower edge 125 and a higher edge 130. This inclination assists the separator 10 in separating the material from the mixed material load position 100 into a first fraction that travels in the direction 105 to the first fraction offload position 110 located adjacent to the higher edge 130 and a second fraction that travels in the direction 115 to the second fraction offload position 120 located adjacent to the lower edge 125. In other words, the separator 10 is constructed to separate the material into a first fraction located adjacent to the higher edge 130 and a second fraction located adjacent to the lower edge 125. The separator bed 12 may be perforated to allow a third fraction 122 of the material to travel through the separator bed 12. With the separator bed 12 of the amplified ballistic separator 10 on an incline, the first fraction of material may be flat materials, the second fraction of material may be rolling materials, and the third fraction of material may be materials below a certain size.

Although heretofore the amplified ballistic separator 10 has been described as comprising an agitator 20 and an amplified agitator 25, in some variations the separator 10 could conceivably be constructed with just an amplified agitator 25 with some mechanisms or mechanical support built into the amplified agitator 25 to replace some of the functions of the agitator 20. Such an amplified ballistic separator 10 for separating and sorting various materials could be constructed with a separator bed 12 adapted to contact the material, the bed comprising an amplified agitator 25 or 25A having an amplified agitator total lateral displacement 35, a crankshaft 15 or 15A having a crankshaft total lateral displacement 15 or 15A and kinematically linked to the amplified agitator 25 or 25A, wherein the amplified agitator total lateral displacement 35 is larger than the crankshaft total lateral displacement 30. Such a separator 10 could also comprise a second crankshaft 17 kinematically linked to the amplified agitator 25 or 25A. Indeed, the separator bed 12 in such a variant embodiment of the ballistic separator 10 may comprise a plurality of amplified agitators 25 or 25A kinematically linked to the crankshaft 15 or 15A. Moreover, the crankshaft 15 or 15A may have multiple phase regions and adjacent amplified agitators 25 or 25A connected to the different phase regions. The amplified agitator 25 or 25A may comprise a saw tooth and may be kinematically linked to the crankshaft 15 or 15A by a cam follower 45 or 45A. The amplified agitator total lateral displacement 35 may be at least 1.5 times larger than the crankshaft total lateral displacement 30. The separator bed 12 may be inclined. The bed 12 may have a lower ledge 125 and a higher edge 130, and the separator 10 may be constructed to separate the material into a first fraction located adjacent to the higher edge and a second fraction located adjacent to the lower edge. Also, the separator bed 12 may be perforated to allow a third fraction of the material being sorted to travel through the bed 12.

FIGS. 16-20 illustrate another embodiment of a ballistic separator 200 with an agitator 20 that has a conveyor 210 powered by the crankshaft 15. A belt/chain 220 may be connected to a sheave 215 such that the rotational action 214 of the crankshaft 15 rotates the sheave 217 and powers the rotation of the conveyor shaft, thus moving the conveyor 210 relative to top surface 205 of the agitator 20 in the direction of arrows 212. Positioned adjacent to the agitator 20 is a second agitator 225 with the same construction as the first. Note that the second agitator 225 is out of phase with respect to the crankshaft 15 or 15A (see FIGS. 5A and 5B); also note that, in some of these figures, the second agitator 225 is not shown with its belt/chain 220 to better show the components underneath.

Figure 16:
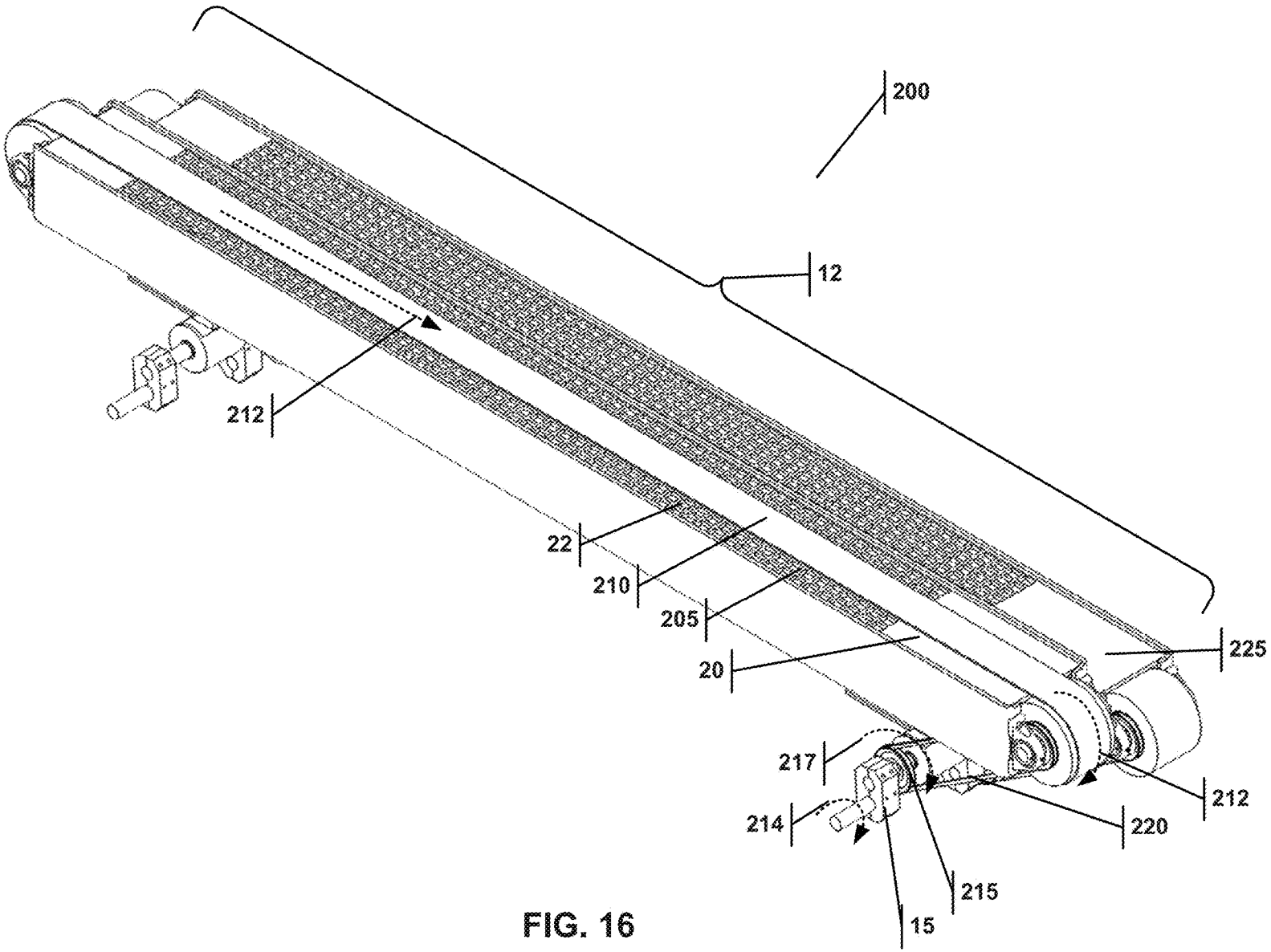
FIG. 16 is a top perspective view of a ballistic separator with a conveyor and two agitators.

FIG. 16 discloses a novel ballistics separator 200 for separating material that comprises a separator bed 12 adapted to contact the material, and the separator bed 12 comprises an agitator 20 with a top surface 205 as well as a conveyor 210 adapted to transport material along the top surface 205. The ballistics separator 200 also comprises a crankshaft 15 or 15A kinematically linked to the agitator 20, where the crankshaft 15 or 15A comprises a rotation action 214; the conveyor 210 is connected to the rotation action 214 of the crankshaft 15 or 15A, so as to move the conveyor 210 relative to the top surface 205. The conveyor 210 may be directly connected to the rotation action 214, or the conveyor 210 may be connected to the rotation action 214 via a belt or a chain 220. FIG. 16 illustrates the conveyor 210 connected to the crankshaft 15 and the crankshaft rotation action 214 through a sheave 215 and a belt or chain 220. As shown (but not labeled) in FIG. 16, the ballistics separator 200 may comprise a second crankshaft 17 kinematically linked to the agitator 20; this second crankshaft 17 may be connected to the conveyor 210 in a similar fashion as the first crankshaft 15 or 15A is connected.

Figure 17:
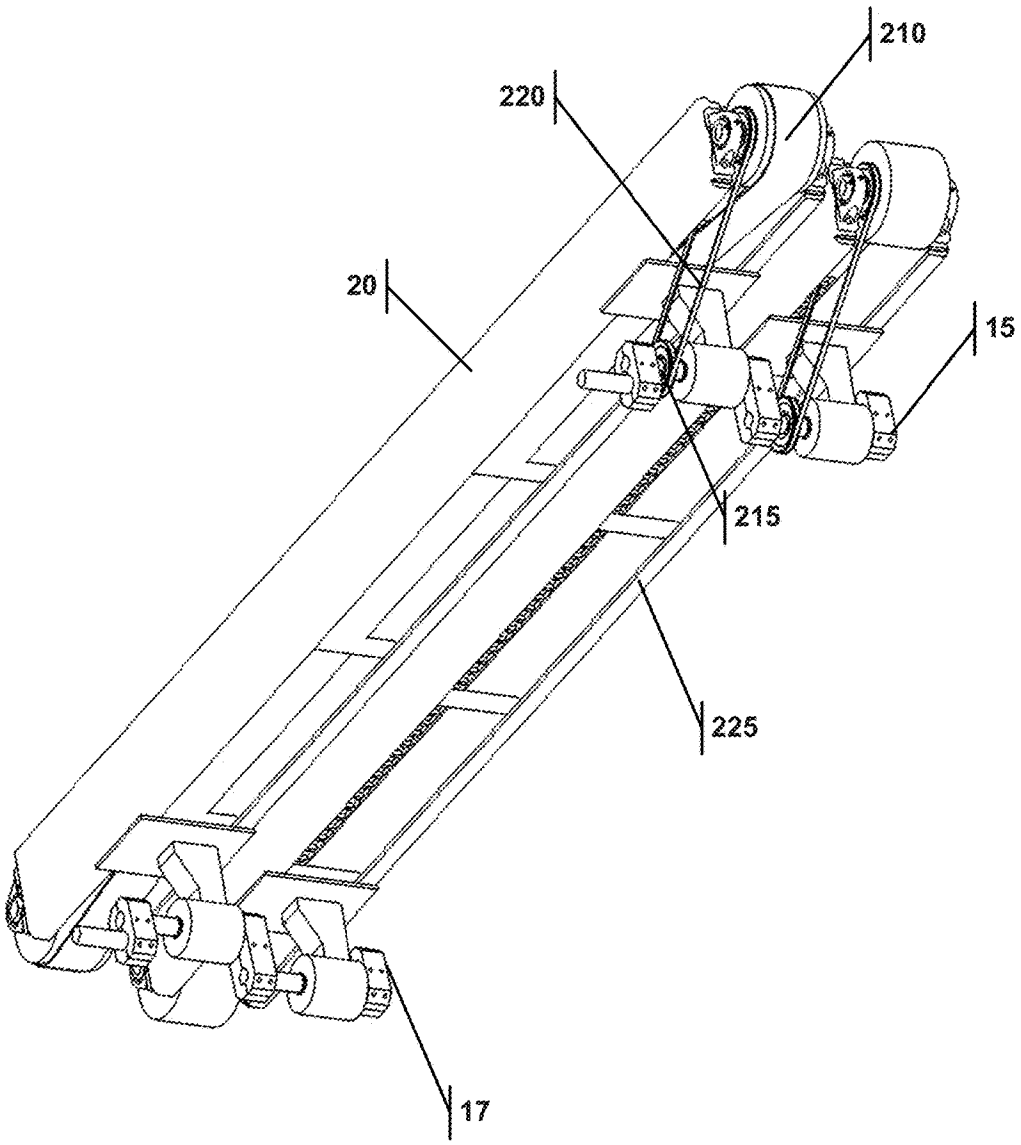
FIG. 17 is a bottom perspective view of the ballistic separator shown in FIG. 16.
Figure 18:
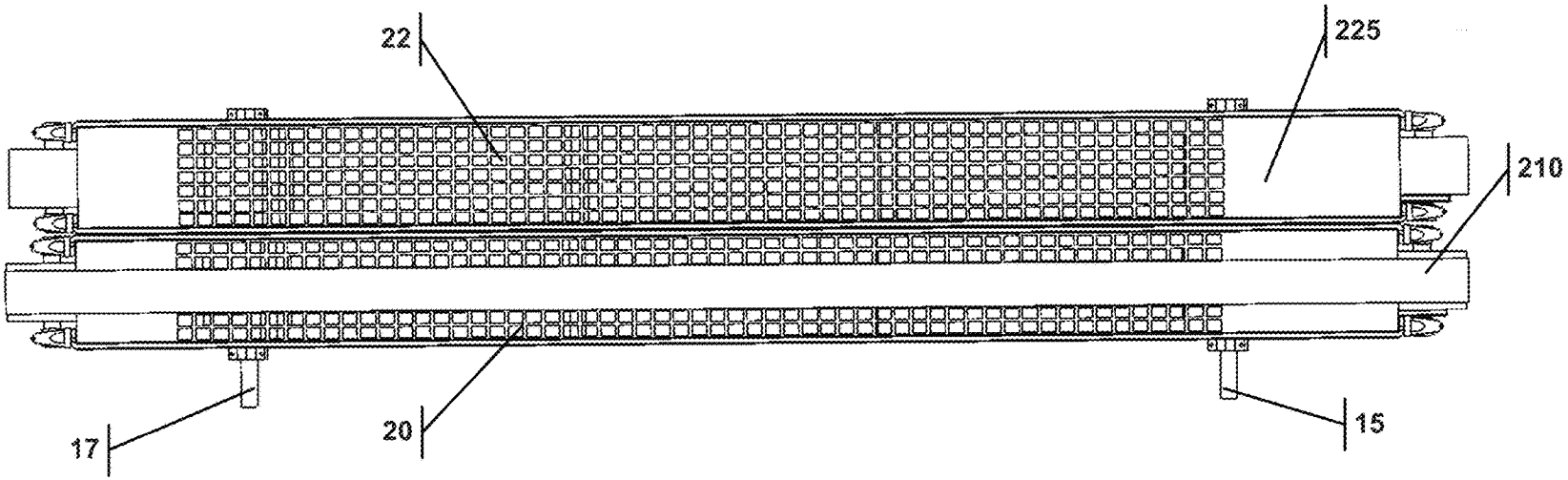
FIG. 18 is a top view of the ballistic separator shown in FIG. 16.

FIG. 16 also illustrates that the ballistics separator 200 may have a second agitator 225 with a second top surface, a second conveyor adapted to transport material along the second top surface, wherein the crankshaft 15 or 15A is kinematically linked to the second agitator 225, and wherein the second conveyor is connected to the rotation action 214 of the crankshaft 15 so as to move the second conveyor relative to the second top surface. The second agitator 225 may be positioned adjacent to the first agitator 20. FIG. 17 is the bottom perspective view, and also shows the placement of the second agitator 225 adjacent to the first agitator 20, and furthermore shows that the second agitator 225 may be connected out of phase, with each agitator connected to a different phase region of the crankshafts 15 and 17. These crankshaft phase regions 85, 90 are illustrated in FIGS. 19 and 20.

Having a second agitator 225 increases the surface area of the separator bed 12, therefore increasing the throughput of the ballistic separator 200. As in the embodiments disclosed previously in the present invention, the separator bed 12 may be inclined to separate rolling materials from flat materials. The inclined separator bed 12 may have a lower edge 125 and a higher edge 130, and the ballistics separator 200 may be constructed to separate the material being sorted into a first fraction located adjacent to the higher edge 130, as well as a second fraction located adjacent to the lower edge 125. As FIG. 16 illustrates, the agitators 20, 225 may have perforations 22 on their top surfaces, so that the separator bed 12 is perforated to allow a third fraction of the material being sorted to travel through the separator bed 12. The first fraction may consist of flat materials, the second fraction may consist of rolling materials, and the third fraction may consist of materials smaller in diameter than the size of the perforations 22. These perforations 22 are most visible in the top view of FIG. 18.

Figure 19:
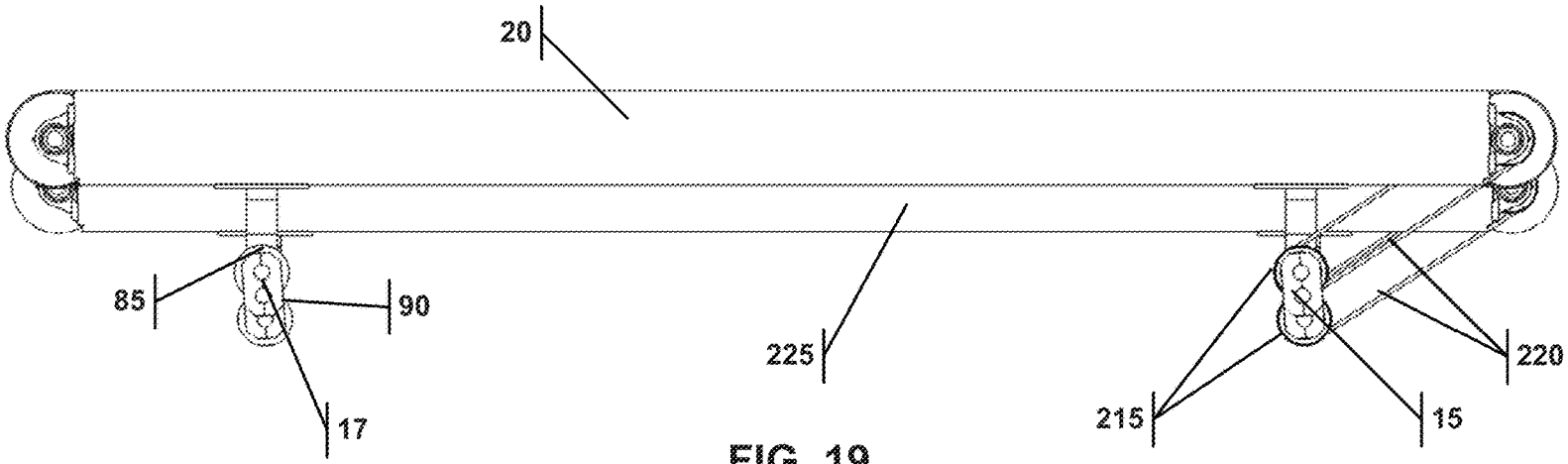
FIG. 19 is a side view of the ballistic separator shown in FIG. 16.
Figure 20:
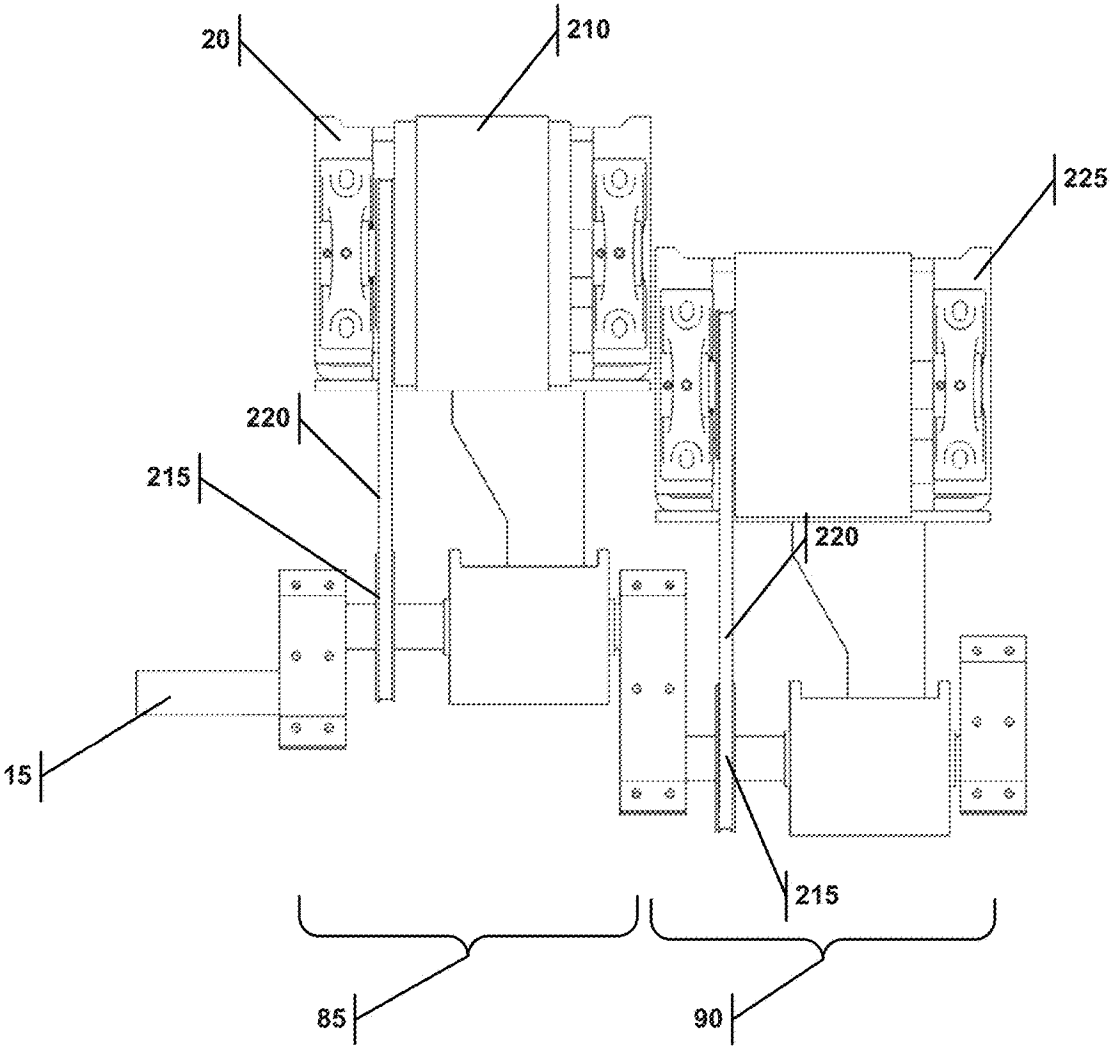
FIG. 20 is a front view of the ballistic separator shown in FIG. 16.

FIGS. 19 and 20 are respectively a side view and a front view of the embodiment of the present invention first disclosed by FIG. 16. Both the agitators 20, 225 are kinematically linked to the crankshaft 15, which has multiple phase regions 85, 90, and the agitator 20 and the second agitator 225 are connected to different phase regions. In FIG. 20, the agitator 20 is connected to the crankshaft phase region 85, and the second agitator 225 is connected to the crankshaft phase region 90. In FIG. 19, the second crankshaft 17 is labeled with a crankshaft phase 1 region 85 and a crankshaft phase 2 region 90. The agitator 20 is connected to the crankshaft region 85, and the agitator 225 is connected to the crankshaft region 90.

Figure 21:
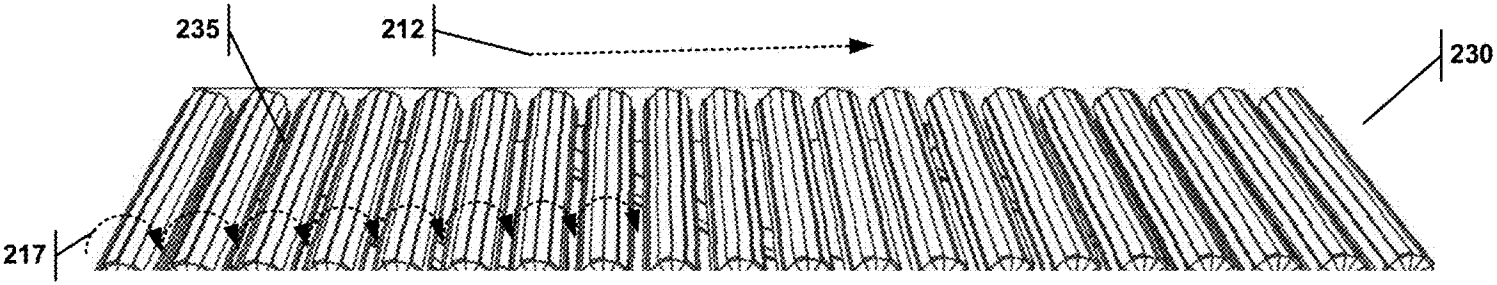
FIG. 21 illustrates a rotating shaft embodiment of the conveyor.
Figure 22A:
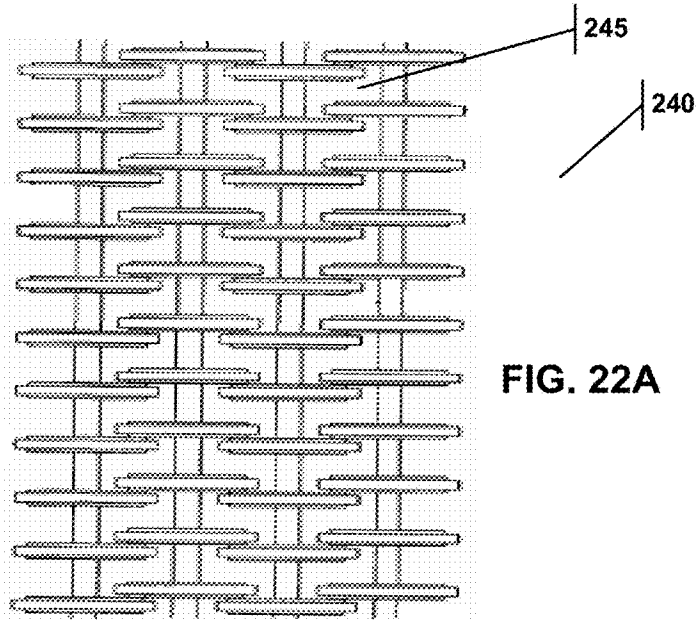
FIG. 22A illustrates a top view of a disc screen embodiment of the conveyor.
Figure 22B:
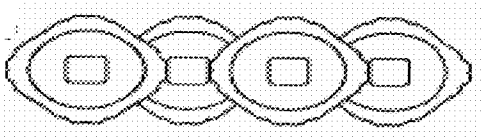
FIG. 22B is a side view of the conveyor shown in FIG. 22A to illustrate the interleaving of the discs.

FIGS. 21-22B illustrate other types of conveyors, including rotating shafts 230 with spaces in between the shafts 235 to allow separation of materials, and a disc screen 240 that also has a space in between the discs 245 for material separation. These types of conveyors are described in the references cited above and incorporated herein by reference.

Thus, the conveyor 210 in either the first or second agitator 20 of the ballistic separator 200 may be comprised of a belt, a chain, a plurality of rotating shafts or a disc screen. All these implementations allow for continuous transport of material, improving throughput.

Figure 23:
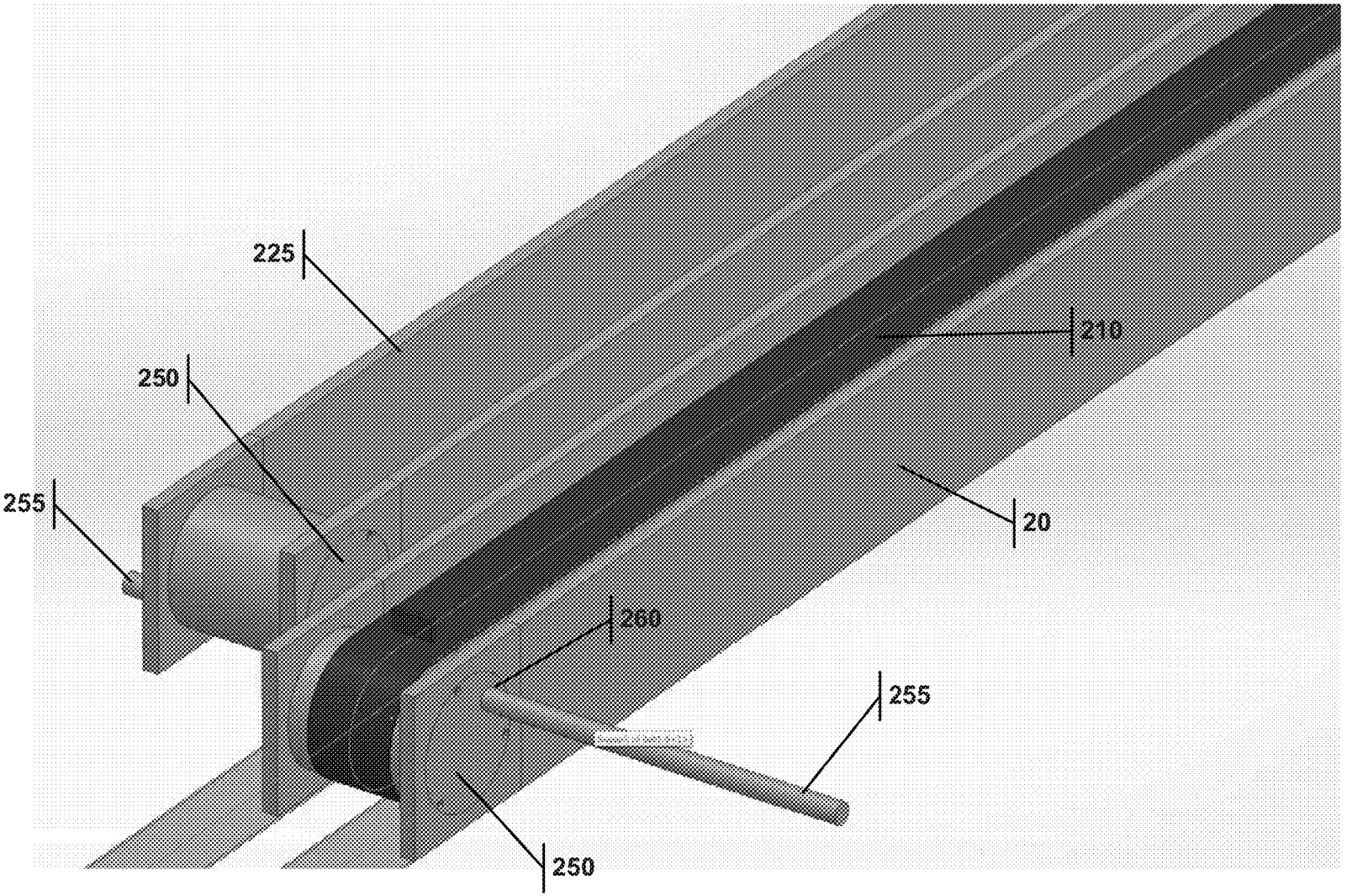
FIG. 23 illustrates a conveyer hub connecting shaft used to rotate an eccentric conveyor hub.
Figure 24:
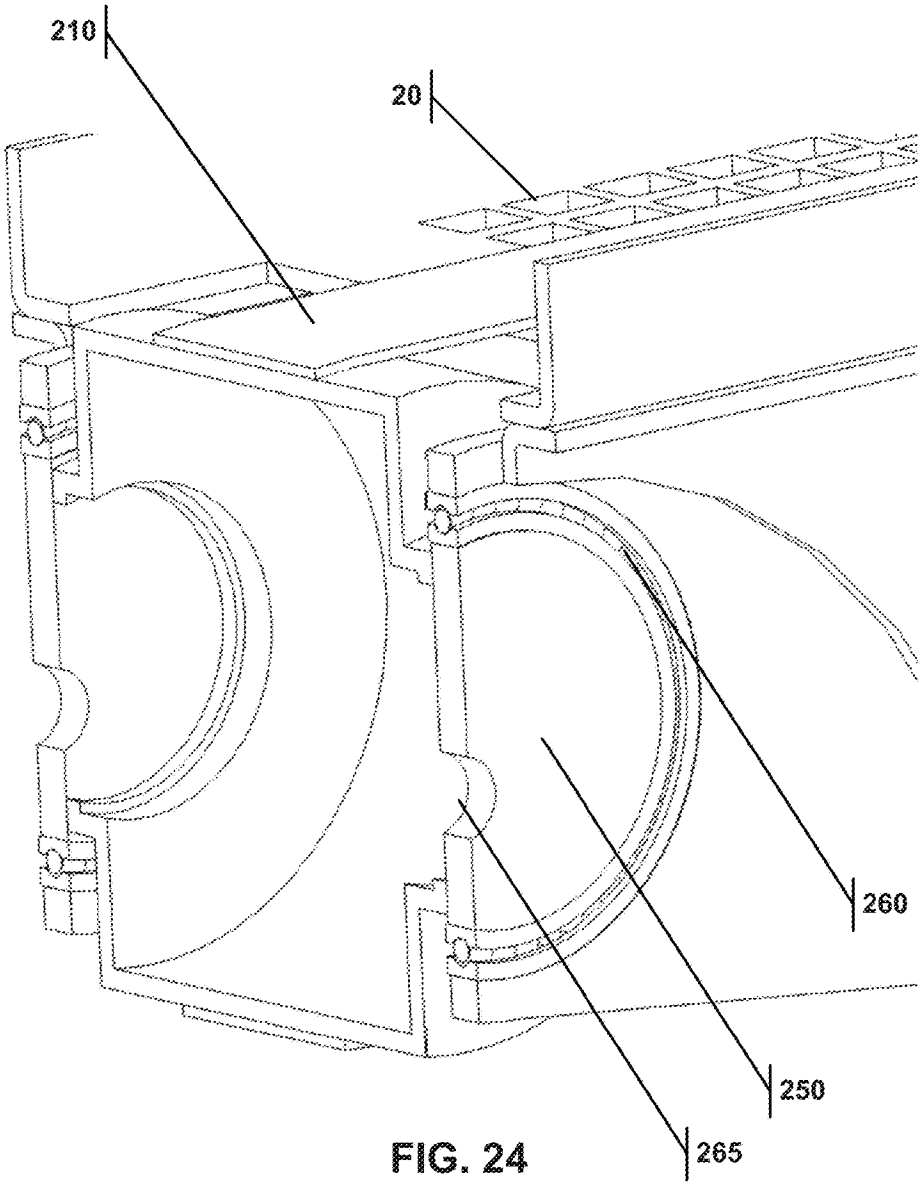
FIG. 24 illustrates a cutaway view of an eccentric conveyor hub.
Figure 25:
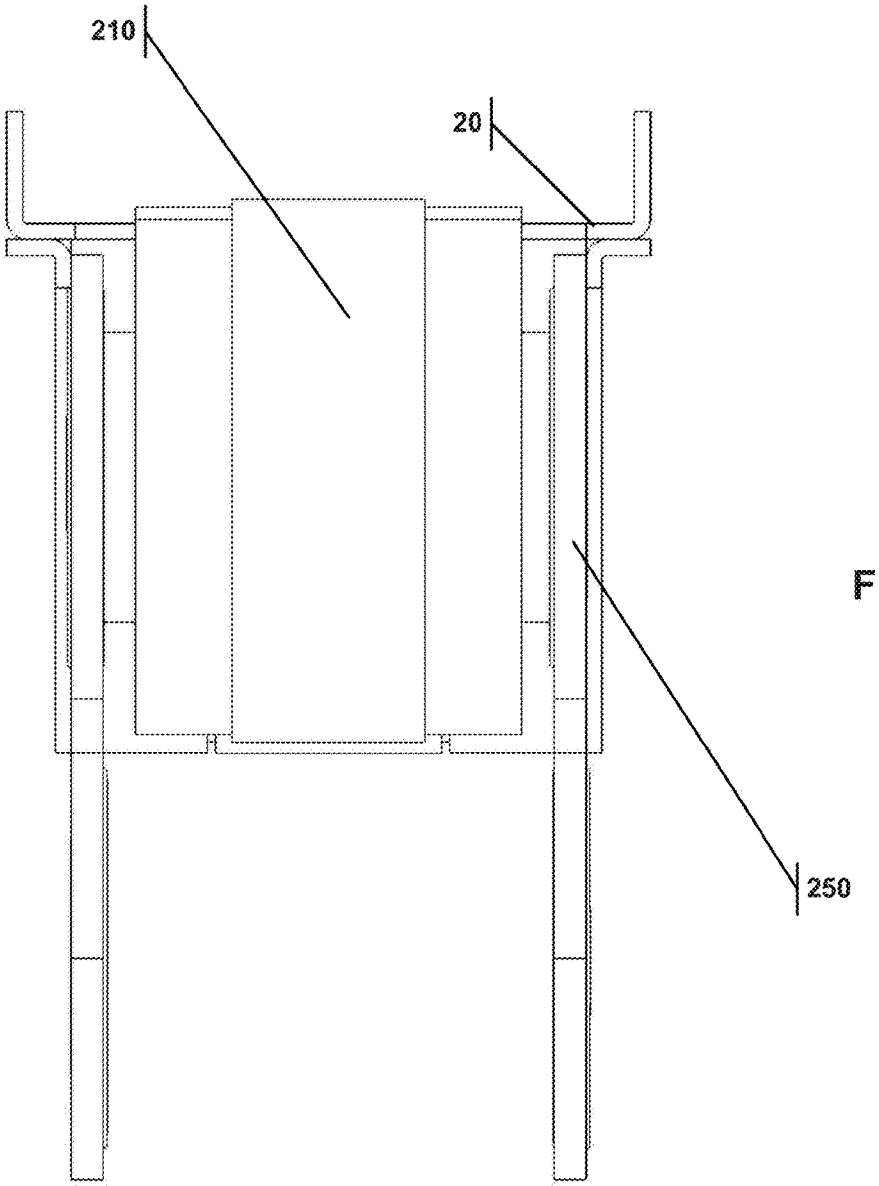
FIG. 25 illustrates a front view of the conveyer hub connecting shaft used to rotate an eccentric conveyor hub.
Figure 26:
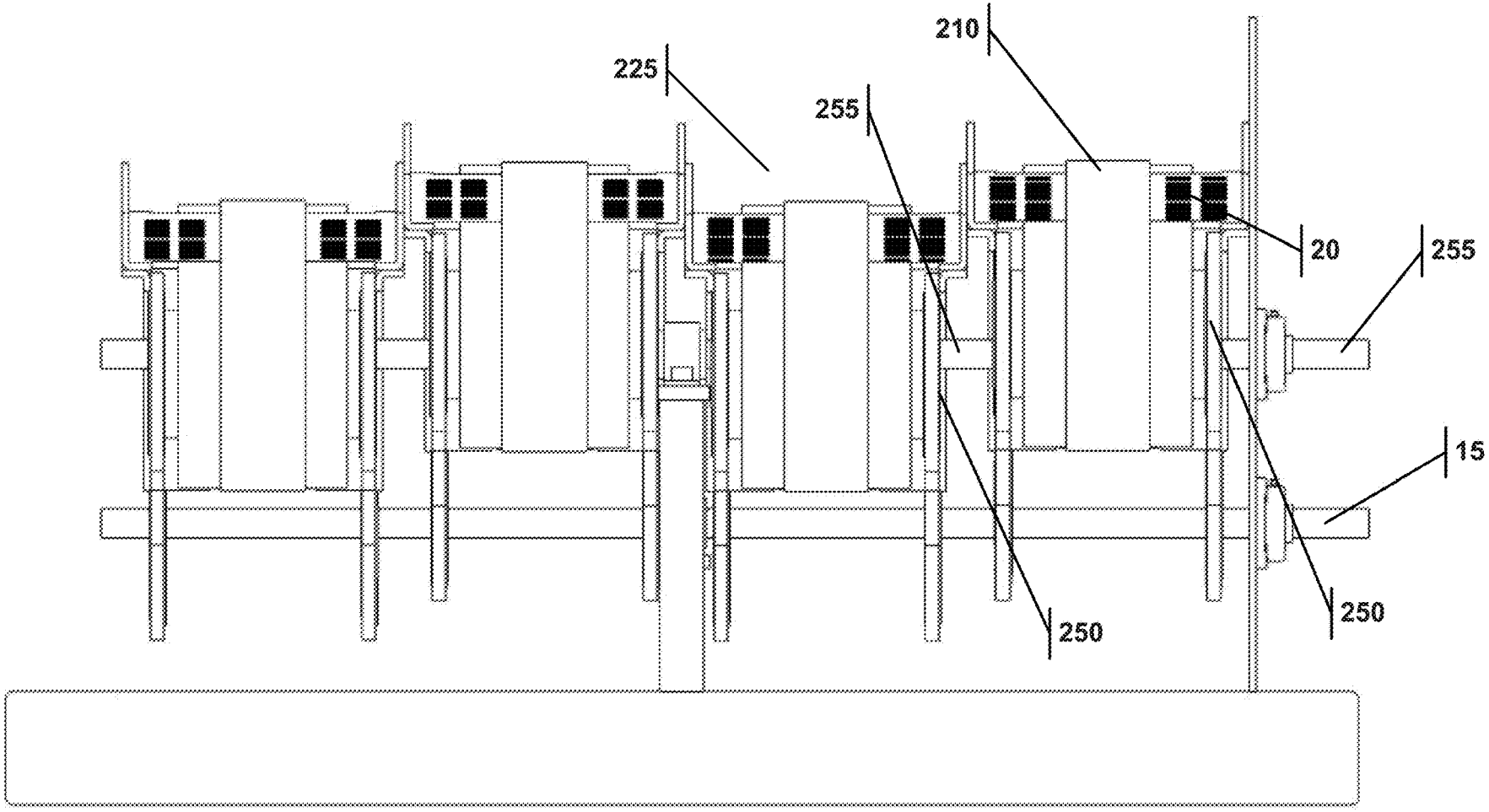
FIG. 26 illustrates a front view of a novel amplified ballistic separator using an eccentric conveyor hub, with four adjacent agitators.
Figure 27:
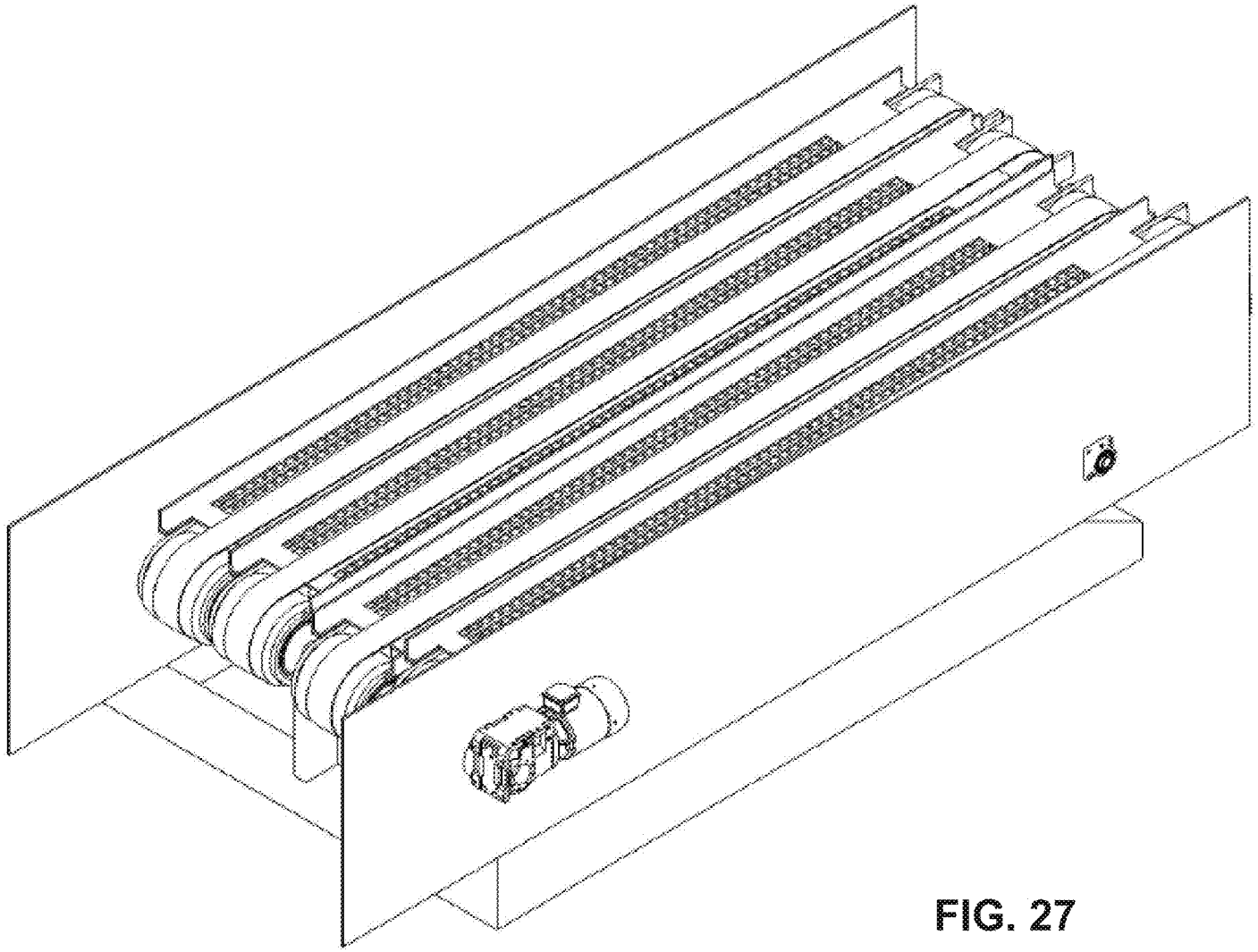
FIG. 27 illustrates a top perspective view of a novel amplified ballistic separator using an eccentric conveyor hub, with four adjacent agitators.
Figure 28:
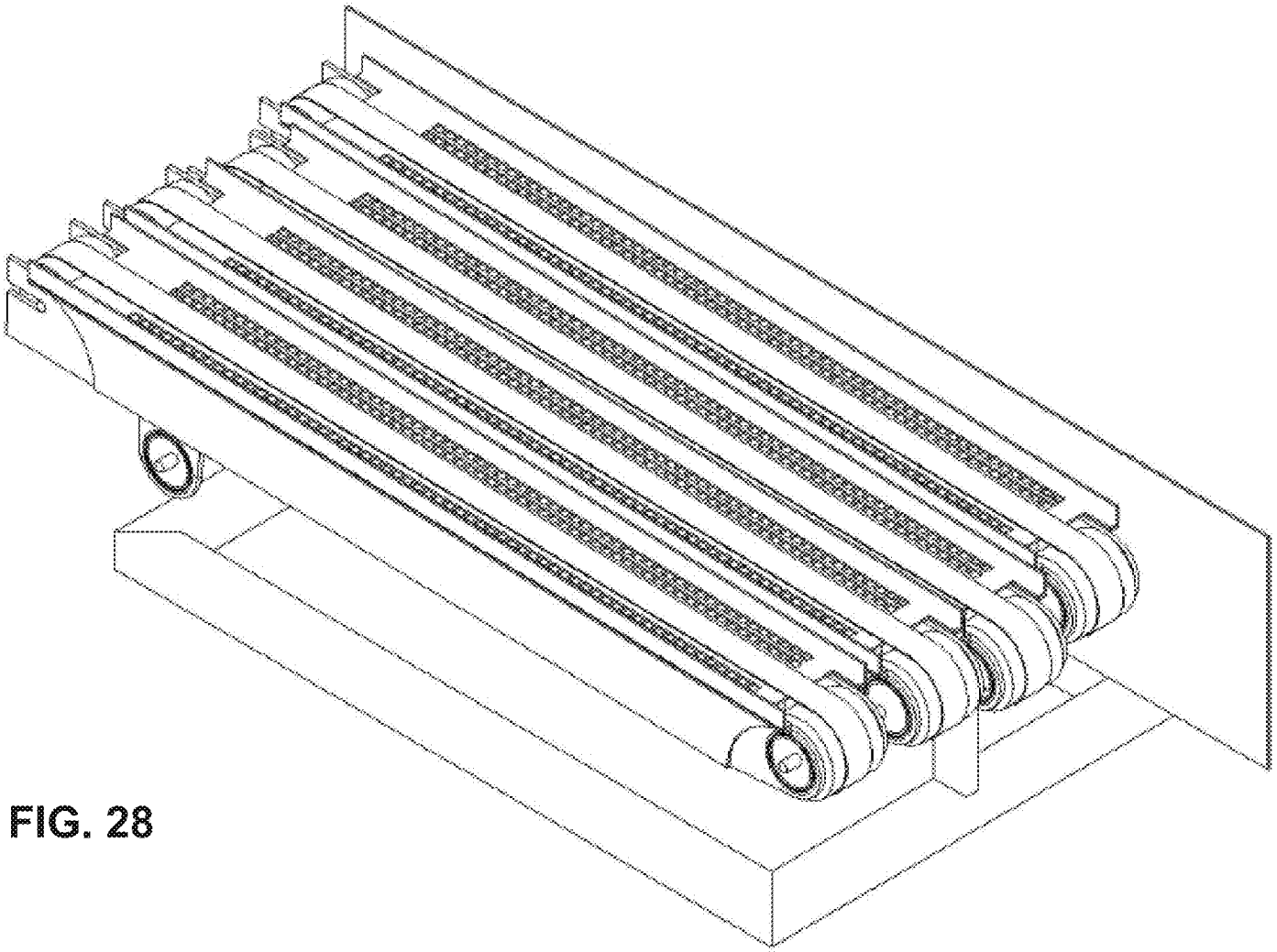
FIG. 28 illustrates a top perspective view of a novel amplified ballistic separator using an eccentric conveyor hub, with four adjacent agitators.
Figure 29:
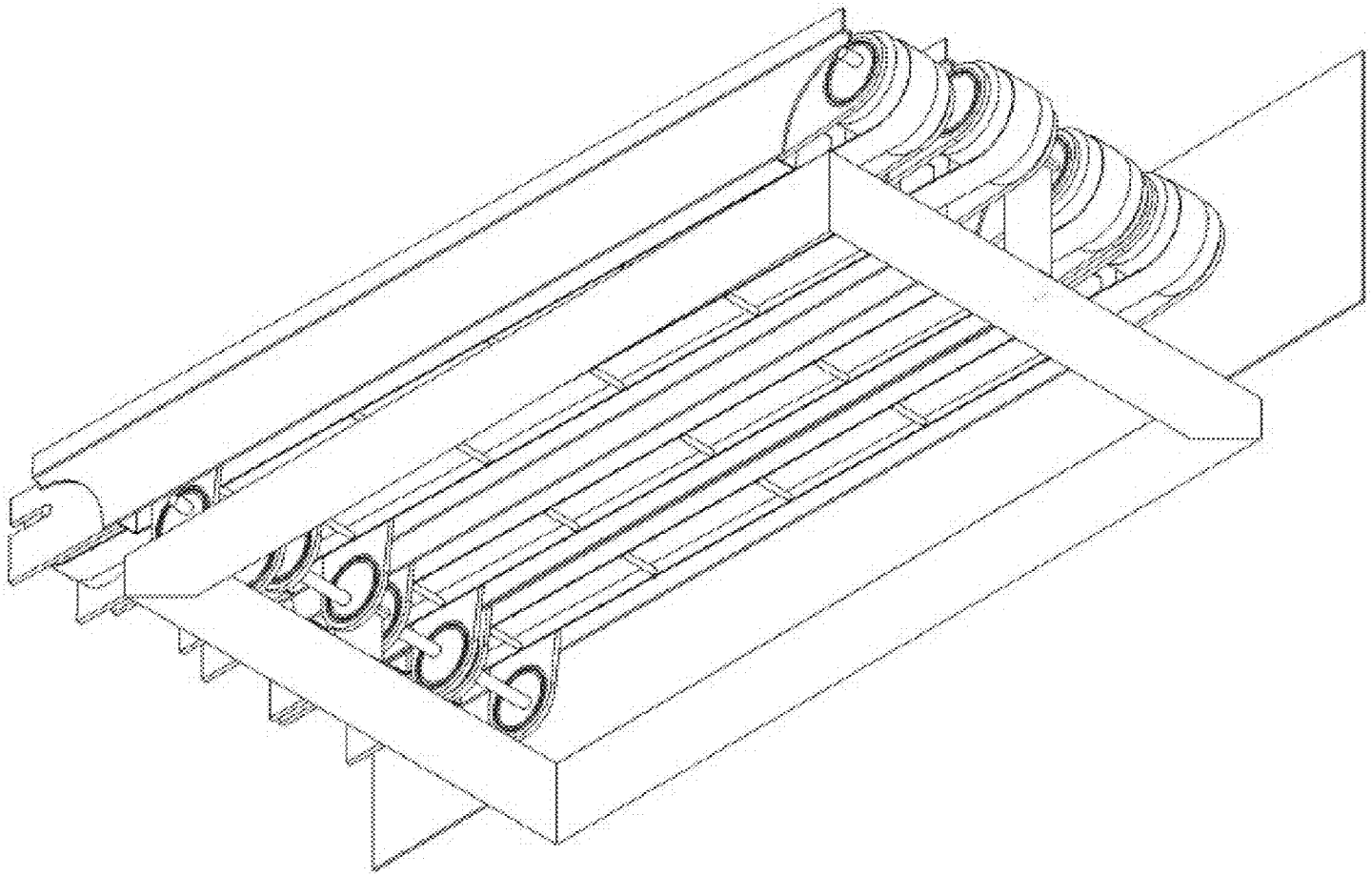
FIG. 29 illustrates a bottom perspective view of a novel amplified ballistic separator using an eccentric conveyor hub, with four adjacent agitators.
Figure 30:
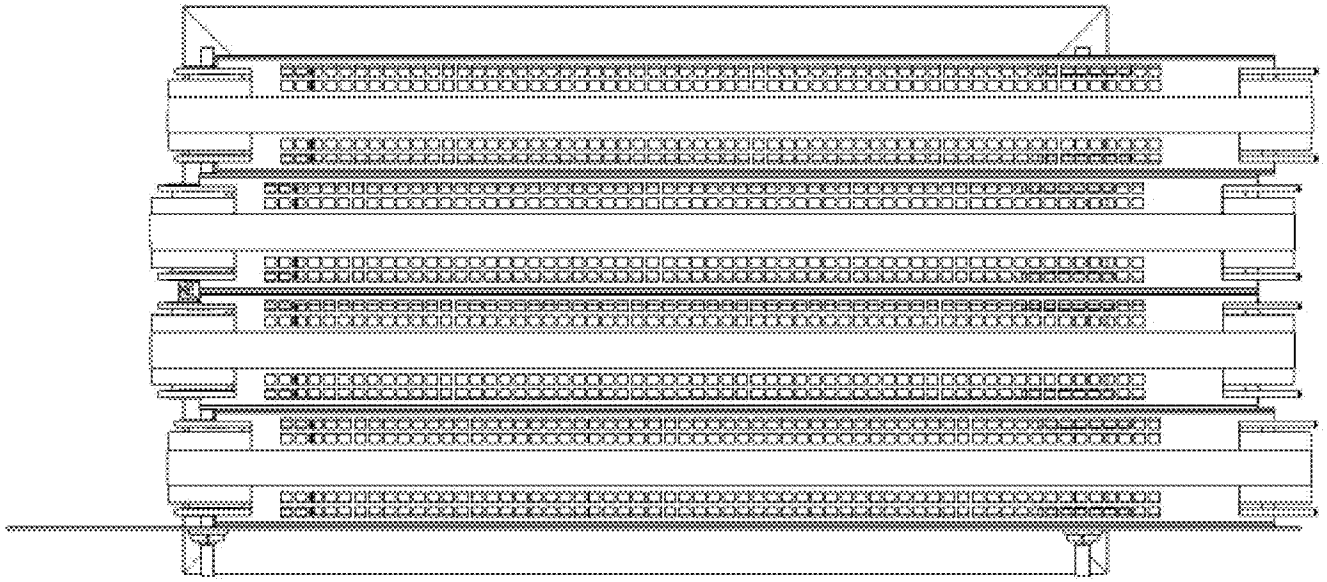
FIG. 30 illustrates a top view of a novel amplified ballistic separator using an eccentric conveyor hub, with four adjacent agitators.
Figure 31:
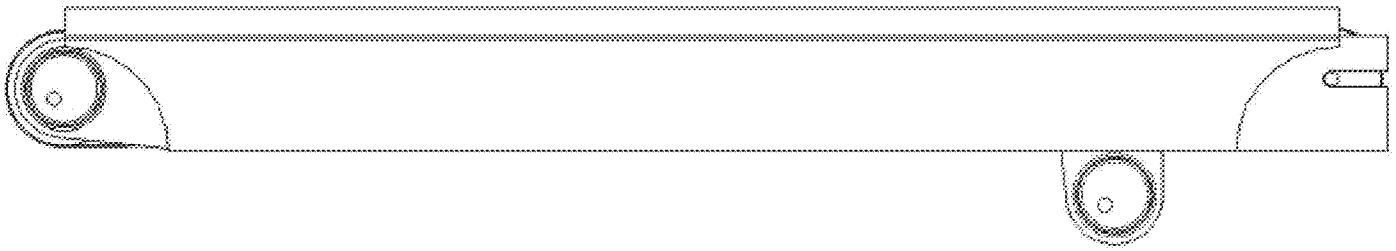
FIG. 31 illustrates a side view of a single agitator that may be used in a novel amplified ballistic separator using an eccentric conveyor hub.
Figure 32:
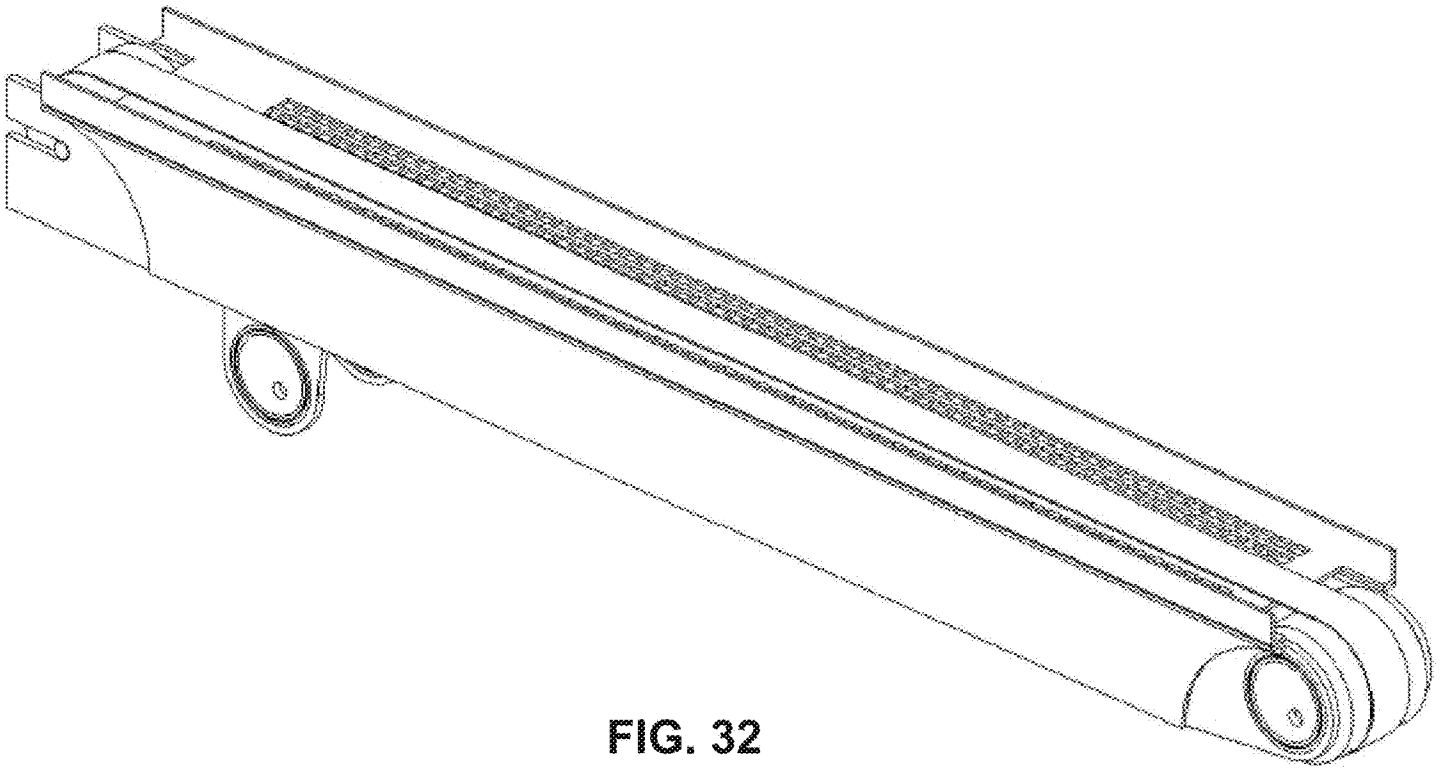
FIG. 32 illustrates a top perspective view of a single agitator that may be used in a novel amplified ballistic separator using an eccentric conveyor hub.

FIG. 23 illustrates a conveyor hub connecting shaft 255, which is straight and connects the eccentric conveyor hubs 250 of adjacent agitators (20 and 225) and use conveyor hub bearings 260. When the agitators (20 and 225) move by the rotational action of the crankshaft, the eccentric conveyor hubs 250 rotate. The action of the conveyor hub connecting shaft 225 and the eccentric conveyor hubs 250 is analogous to the crankshaft 15A described in FIG. 5B. Specifically, the crankshaft in FIG. 5B uses a straight shaft 135 on eccentric discs 140 to convert rotational motion into the oscillating and translating motion of the agitators. The conveyor hub connecting shaft 255 and the eccentric conveyor hubs 250 convert this motion back into rotational motion.

The ballistic separator 200 previously implemented could be implemented with this variation shown in FIG. 23, where the agitator 20 and second agitator 225 each have an eccentric conveyor hub 250 connected to each other by a conveyor hub connecting shaft 255. In such a variation, as FIG. 23 depicts, the crankshaft 15 or 15A (not pictured) may have multiple phase regions 85, 90, and the agitator 20 and second agitator 225 may be connected to different phase regions. FIGS. 24-32 illustrate various views of this construction.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." *Phillips* v. *AHW Corp.,* 415 F.3d 1303, 1323 (Fed. Cir. 2005) (en banc).

The invention claimed is:

1. A ballistic separator for separating material, the separator comprising:

a separator bed adapted to contact the material, the bed comprising:

a first agitator with a top surface, the top surface comprising a conveyor connected to the first agitator;

a crankshaft constructed to impart an oscillating motion to the first agitator and conveyor, wherein the first agitator and conveyor move fixed together relative to the oscillating motion;

wherein the conveyor is constructed to move laterally across the top surface.

2. The separator of claim 1, wherein the conveyor is a belt, a chain, a plurality of rotating shafts or a disc screen.

3. The separator of claim 1, wherein the conveyor is connected to the crankshaft with a belt or a chain.

4. The separator of claim 1, wherein the bed is inclined.

5. The separator of claim 4, where the bed has a lower edge and a higher edge, and the separator is constructed to separate the material into a first fraction located adjacent to the higher edge and a second fraction located adjacent to the lower edge.

6. The separator of claim 5, wherein the bed is perforated to allow a third fraction of the material to travel through the bed.

7. The separator of claim 1, the separator further comprising a second crankshaft linked to the first agitator.

8. The separator of claim 1, further comprising:

a second agitator with a second top surface, the second top surface comprising a second conveyor, wherein the crankshaft imparts an oscillating motion to the second agitator and second conveyor.

9. The separator of claim 8, wherein the second agitator is positioned adjacent to the first agitator.

10. The separator of claim 8, wherein the second conveyor is a belt, a chain, a plurality of rotating shafts or a disc screen.

11. The separator of claim 8, wherein the crankshaft has multiple phase regions and the first agitator and second agitator are connected to different phase regions.

12. The separator of claim 8, wherein the first agitator and the second agitator each have an eccentric conveyor hub connected to each other by a conveyor hub connecting shaft.

13. The separator of claim 12, wherein the crankshaft has multiple phase regions and the first agitator and second agitator are connected to different phase regions.

14. The separator of claim 1, wherein the bed is perforated to allow a fraction of the material to travel through the bed.

* * * * *